US010488774B2

(12) United States Patent
Inoue et al.

(10) Patent No.: US 10,488,774 B2
(45) Date of Patent: Nov. 26, 2019

(54) IMAGE FORMING APPARATUS AND IMAGE FORMING METHOD

(71) Applicants: Daisuke Inoue, Shizuoka (JP); Takahiro Honda, Shizuoka (JP); Masami Okamoto, Kanagawa (JP); Kenta Kashiwagi, Kanagawa (JP); Kaori Hemmi, Kanagawa (JP); Yoshihisa Hara, Kanagawa (JP)

(72) Inventors: Daisuke Inoue, Shizuoka (JP); Takahiro Honda, Shizuoka (JP); Masami Okamoto, Kanagawa (JP); Kenta Kashiwagi, Kanagawa (JP); Kaori Hemmi, Kanagawa (JP); Yoshihisa Hara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/290,358

(22) Filed: Mar. 1, 2019

(65) Prior Publication Data

US 2019/0271927 A1 Sep. 5, 2019

(30) Foreign Application Priority Data

Mar. 2, 2018 (JP) ..... 2018-037452

(51) Int. Cl.

| | |
|---|---|
| ***G03G 9/08*** | (2006.01) |
| ***G03G 9/087*** | (2006.01) |
| ***G03G 15/20*** | (2006.01) |

(52) U.S. Cl.

CPC ..... *G03G 9/08755* (2013.01); *G03G 9/08782* (2013.01); *G03G 9/08797* (2013.01); *G03G 15/2053* (2013.01)

(58) Field of Classification Search

CPC ..... G03G 9/08755; G03G 9/08797; G03G 15/2053

(Continued)

(56) References Cited

U.S. PATENT DOCUMENTS

| | | | |
|---|---|---|---|
| 2010/0233609 | A1 | 9/2010 | Higuchi et al. |
| 2011/0003244 | A1 | 1/2011 | Inoue et al. |

(Continued)

FOREIGN PATENT DOCUMENTS

| | | |
|---|---|---|
| JP | 2004-046095 | 2/2004 |
| JP | 2007-271789 | 10/2007 |

(Continued)

*Primary Examiner* — Mark A Chapman

(74) *Attorney, Agent, or Firm* — Oblon, McClelland, Maier & Neustadt, L.L.P.

(57) ABSTRACT

An image forming apparatus including a developing device and a fixing device is provided. The fixing device includes a fixing rotator having a fixing surface, an opposing rotator opposing the fixing rotator to form a nip portion therebetween, and a fixing surface reformer having an abutting layer to abut the fixing surface. The abutting layer contains abrasive grains having an average grain size of 2.0-6.5 μm on a surface which abuts the fixing surface. The toner comprises a crystalline polyester resin and exhibits G' (storage elastic modulus) of $1.0\times10^7$ Pa or lower at 70° C. in a temperature rising in a viscoelasticity measurement, G' of $1.0\times10^7$ Pa or higher at 70° C. in a temperature falling in the viscoelasticity measurement, and an endothermic peak indicating an amount of heat absorption of from 2.0 to 8.0 J/g, derived from the crystalline polyester resin, in a first temperature rising in DSC.

10 Claims, 3 Drawing Sheets

(58) Field of Classification Search
USPC ..... 430/109.4
See application file for complete search history.

(56) References Cited

U.S. PATENT DOCUMENTS

| | | | |
|---|---|---|---|
| 2011/0200928 | A1 | 8/2011 | Watanabe et al. |
| 2011/0262856 | A1 | 10/2011 | Sugimoto et al. |
| 2011/0305986 | A1 | 12/2011 | Ogawa et al. |
| 2012/0021347 | A1 | 1/2012 | Shimota et al. |
| 2012/0288299 | A1 | 11/2012 | Uchinokura et al. |
| 2013/0022371 | A1 | 1/2013 | Kusahara et al. |
| 2013/0130171 | A1 | 5/2013 | Watanabe et al. |
| 2013/0196260 | A1 | 8/2013 | Yoshida et al. |
| 2013/0196261 | A1 | 8/2013 | Uchinokura et al. |
| 2013/0244155 | A1 | 9/2013 | Satoh et al. |
| 2013/0244156 | A1 | 9/2013 | Kojima et al. |
| 2013/0244158 | A1 | 9/2013 | Awamura et al. |
| 2016/0195826 | A1 | 7/2016 | Kimura et al. |
| 2016/0195827 | A1 | 7/2016 | Murayama et al. |
| 2016/0195828 | A1 | 7/2016 | Satoh et al. |
| 2016/0231661 | A1 | 8/2016 | Nagai et al. |
| 2016/0259257 | A1 | 9/2016 | Sugimoto et al. |
| 2016/0370720 | A1 | 12/2016 | Yamashita et al. |
| 2016/0378006 | A1 | 12/2016 | Itoh et al. |
| 2017/0269522 | A1 | 9/2017 | Kubota et al. |
| 2017/0269524 | A1 | 9/2017 | Yamaji et al. |
| 2017/0269525 | A1 | 9/2017 | Okamoto et al. |
| 2017/0269526 | A1 | 9/2017 | Yuasa et al. |
| 2017/0357197 | A1 | 12/2017 | Okamoto et al. |
| 2018/0052403 | A1 | 2/2018 | Inoue et al. |
| 2018/0059598 | A1 | 3/2018 | Hasegawa et al. |
| 2018/0081309 | A1 | 3/2018 | Hirose et al. |
| 2018/0267449 | A1 | 9/2018 | Naitoh et al. |

FOREIGN PATENT DOCUMENTS

| | | |
|---|---|---|
| JP | 2015-052697 | 3/2015 |
| JP | 2015-118151 | 6/2015 |
| JP | 2016-164616 | 9/2016 |
| JP | 2017-009982 | 1/2017 |

IMAGE FORMING APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2018-037452, filed on Mar. 2, 2018, in the Japan Patent Office, the entire disclosure of which is hereby incorporated by reference herein.

BACKGROUND

Technical Field

The present disclosure relates to an image forming apparatus and an image forming method.

Description of the Related Art

In recent years, toner has been required to have a small particle size and high-temperature offset resistance for higher image quality, low-temperature fixability for energy saving, and heat-resistant storage stability to be resistant to high temperature and high humidity during storage or transportation after manufacture. Since most of the power consumed during an image forming process is used for fixing toner on a recording medium, it is effective for saving energy to improve low-temperature fixability of the toner.

In attempting to achieve a high level of low-temperature fixability, a toner has been proposed which contains a crystalline polyester resin and a release agent that are incompatible with each other and forming a sea-island phase separation structure in the toner. A toner containing a crystalline polyester resin, a release agent, and a graft polymer has also been proposed. Further, a toner containing two types of amorphous polyester resins and one type of crystalline polyester resin has been proposed in attempting to improve low-temperature fixability, heat-resistant storage stability, and high-temperature high-humidity storage stability.

These toners may provide low-temperature fixability since the crystalline polyester resin more rapidly melts than amorphous polyester resins. However, a toner containing a crystalline polyester resin has a drawback that the toner is likely to aggregate in a high-temperature high-humidity environment. Further, in recent years, there is a problem of "sheet ejection blocking" that is a phenomenon caused when sheets of paper having a fixed toner image thereon are stacked on a sheet ejection tray, in which the sheets and the toner stick to each other due to the pressure (weight) from the sheets and residual heat of the fixing process.

This phenomenon occurs as the toner image portion of another sheet is superimposed on the toner remaining softened without being sufficiently cooled after melting. In view of this, there has been an attempt to achieve low-temperature fixability of toner and to prevent the occurrence of sheet ejection blocking at the same time, by adjusting viscoelasticity of toner.

On the other hand, recent ultrahigh-speed printing systems use a fixing device equipped with a surface recovery (polishing) member capable of reducing roughness of the surface of a fixing member, caused by scratching of the surface by the edge portion of a recording medium that passes thereon, for preventing the occurrence of abnormal image caused due to scratched surface of the fixing member.

However, polishing of the surface of the fixing member results in formation of scratch ("polishing streaks") on the surface. When a toner image is formed on a recording medium with the fixing member having polishing streaks thereon, the surface of the toner image may be faithfully shaped into the shape of the polishing streaks and appeared as "image streaks" on the fixed image.

SUMMARY

In accordance with some embodiments of the present invention, an image forming apparatus is provided. The image forming apparatus includes a developing device and a fixing device. The developing device contains a toner and is configured to form a visible image with the toner. The fixing device is configured to fix the visible image on a recording medium and includes a fixing rotator having a fixing surface, an opposing rotator disposed opposing the fixing rotator to form a nip portion therebetween, and a fixing surface reformer having an abutting layer to abut the fixing surface. The abutting layer contains abrasive grains having an average grain size of from 2.0 to 6.5 μm on a surface thereof which abuts the fixing surface. The toner comprises a crystalline polyester resin and exhibits a storage elastic modulus G' of $1.0\times10^7$ Pa or lower at 70° C. in a temperature rising in a viscoelasticity measurement, a storage elastic modulus G' of $1.0\times10^7$ Pa or higher at 70° C. in a temperature falling in the viscoelasticity measurement, and an endothermic peak indicating an amount of heat absorption of from 2.0 to 8.0 J/g, derived from the crystalline polyester resin, in a first temperature rising in a differential scanning calorimetry (DSC).

In accordance with some embodiments of the present invention, an image forming method is provided. The image forming method includes the processes of: forming a visible image with a toner; and fixing the visible image on a recording medium with a fixing device. Here, the fixing device and the toner are those included in the above-described image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
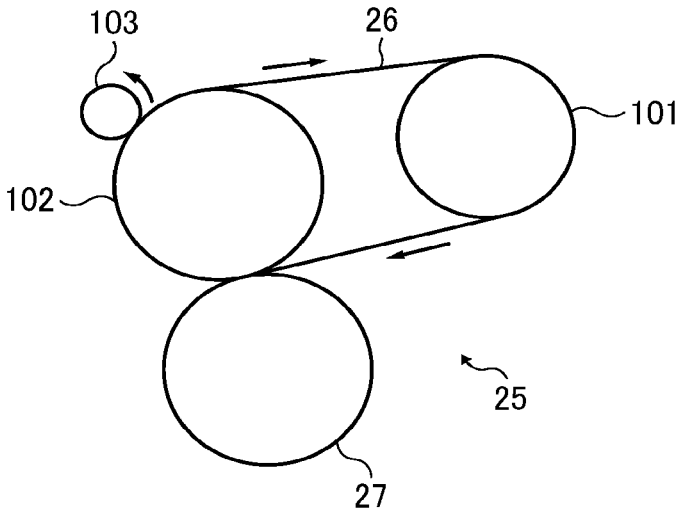
FIG. 1 is a magnified cross-sectional view of a fixing device according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with an embodiment of the present invention, an image forming apparatus is provided that provides excellent low-temperature fixability, sheet ejection blocking resistance, and image gloss and prevents the occurrence of image streaks.

Image Forming Apparatus and Image Forming Method

The image forming apparatus according an embodiment of the present invention includes a developing device containing a toner, and a fixing device.

The image forming method according to an embodiment of the present invention includes a visible image forming process and a fixing process.

The inventors of the present invention conducted intensive studies to provide an image forming apparatus that provides excellent low-temperature fixability, sheet ejection blocking resistance, and image gloss and prevents the occurrence of image streaks.

When the toner exhibits a storage elastic modulus G' of $1.0\times10^7$ Pa or lower at 70° C. in a temperature rising in a viscoelasticity measurement, thermoplasticity of the toner itself is excellent and the toner can be fixed at low temperatures.

To prevent the occurrence of sheet ejection blocking, it is desirable that the toner exhibits a high storage elastic modulus G', i.e., of $1.0\times10^7$ Pa or higher, at 70° C. in a temperature falling in the viscoelasticity measurement. Under such conditions, the toner image portions are sufficiently hard at the sheet ejection temperature and do not fuse with each other, thus preventing sheet ejection blocking.

On the other hand, the fact that the toner exhibits a high storage elastic modulus G' at 70° C. in a temperature falling in the viscoelasticity measurement is one cause of generation of image streaks in the image forming apparatus having a fixing device equipped with a surface recovery (polishing) member. When the image forming apparatus having a fixing device equipped with a surface recovering (polishing) member is used in combination with a toner exhibiting a high storage elastic modulus G' in a temperature falling in the viscoelasticity measurement, the following problem occurs.

That is, the surface of the fixing member is scratched by polishing and polishing streaks are formed thereon. When a toner image is formed on a recording medium with the fixing member having polishing streaks thereon, the surface of the toner image may be faithfully shaped into the shape of the polishing streaks and appeared as "image streaks" on the fixed image.

The inventors of the present invention focused attention on crystalline polyester resin to achieve low-temperature fixability of toner. The inventors then found that when the toner exhibits an endothermic peak derived from the crystalline polyester resin which indicates an amount of heat absorption of 2.0 J/g or higher in a first temperature rising in a differential scanning calorimetry (DSC), the occurrence of image streaks can be prevented. An image formed with a toner containing a crystalline polyester resin can remain melted after being fixed on the recording medium. Therefore, even when the image is formed using a fixing member having polishing streaks thereon, polishing streaks are likely to disappear from the image. However, when the endothermic peak indicates the amount of heat absorption of lower than 2.0 J/g, the thermoplastic effect is insufficient and image streaks are generated.

When the endothermic peak indicates the amount of heat absorption of higher than 8.0 J/g, the hardness of the image portions at the sheet ejection temperature are insufficient and the image portions are fused to each other, causing sheet ejection blocking. Therefore, the amount of heat absorption indicated by the endothermic peak is 8.0 J/g or less to be resistant to sheet ejection blocking.

In conducting the above studies, the inventors of the present invention encountered the case in which the image gloss was lowered. Further investigation focusing on abrasive grains has found that the image gloss is not impaired when the average grain size of the abrasive grains is 6.5 μm or less. On the other hand, when the average grain size of the abrasive grains is less than 2.0 μm, the effect of reforming the surface of the fixing member is poor, and as a result, image streaks are formed on the fixed image.

Thus, the present invention has been completed.

The image forming apparatus according to an embodiment of the present invention may further include an electrostatic latent image bearer, an electrostatic latent image forming device, and a transfer device, and optionally other devices.

The image forming method according to an embodiment of the present invention may further include an electrostatic latent image forming process and a transfer process, and optionally other processes.

Fixing Device and Fixing Process

The fixing device fixes a visible image formed with toner on a recording medium.

The fixing process is for fixing a visible image formed with toner on a recording medium, and is performed by the fixing device.

The fixing device includes a fixing rotator, an opposing rotator, and a fixing surface reformer, and further includes other members as required.

The fixing rotator is to fix the visible image on the recording medium.

The opposing rotator is disposed facing the fixing rotator to form a nip portion therebetween.

The fixing surface reformer has an abutting layer to abut the surface of the fixing rotator to reform the surface of the fixing rotator.

The abutting layer contains abrasive grains having an average grain size of from 2.0 to 6.5 μm on a surface thereof which abuts the surface of the fixing rotator.

It is preferable that the abutting layer has a ten-point average roughness (Rzjis) within a range of from 50 to 90 μm.

In addition, it is preferable that the abutting layer has a peak-to-valley average distance (Sm) within a range of from 90 to 140 μm.

The ten-point average roughness (Rzjis) and the peak-to-valley average distance (Sm) can be measured according to JIS (Japanese Industrial Standards) B 0601-2001.

The fixing device according to an embodiment of the present invention is described below with reference to the drawings.

FIG. 1 is a magnified cross-sectional view of a fixing device 25 according to an embodiment of the present invention.

The fixing device 25 illustrated in FIG. 1 includes a fixing roller 102, a heating roller 101 in which a halogen heater as a heating source is installed, a fixing belt 26 as a fixing rotator, a pressure roller 27 as a pressure rotator in which a halogen heater is installed, and a fixing surface reformer 103.

The fixing belt 26 is stretched between the fixing roller 102 and the heating roller 101. The pressure roller 27 presses a sheet (recording medium) against the fixing belt 26. In the present embodiment, a halogen heater is installed inside the pressure roller 27. In addition, the pressure roller 27 is disposed so as to form a nip portion between the fixing roller 102 and the pressure roller 27 via the fixing belt 26.

A sheet carrying toner is guided to the nip portion to be heated and pressed so that the toner is fixed on the sheet. The leading edge of the sheet on which the toner has been fixed is separated by a separation plate disposed on the side of the fixing roller 102 or a separation plate disposed on the side of the pressure roller 27 and is ejected toward the next step.

The fixing device is not limited to the fixing device 25 having the configuration illustrated in FIG. 1. For example, a halogen heater may be provided inside the fixing roller 102, or the fixing belt 26 and/or the heating roller 101 may be omitted. The heating source may adopt induction heating (IH). The fixing surface reformer may be configured to reform the surface of a fixing roller as the fixing rotator. Further, separation plates respectively disposed on the fixing roller side and the pressure roller side may be configured as separating claws.

The fixing belt 26 has a multilayer structure in which an elastic layer and a release layer are laminated in order on a base layer made of PI (polyimide) resin having a layer thickness of 90 μm. The elastic layer of the fixing belt 26 has a layer thickness of about 200 μm and is formed of an elastic material such as silicone rubber, fluororubber, and foamable silicone rubber. The release layer has a layer thickness of about 20 μm and is formed of a material such as PFA (tetrafluoroethylene perfluoroalkyl vinyl ether copolymer resin), polyimide, polyether imide, and PES (polyether sulfide). As the release layer is provided, toner (toner image) can be securely released (separated) from the fixing belt 26.

Figure 2:
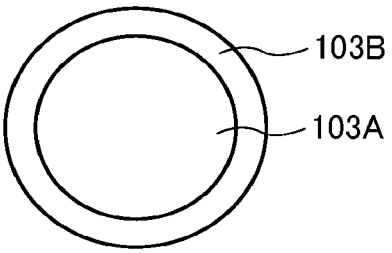
FIG. 2 is a magnified cross-sectional view of a fixing surface reformer according to an embodiment of the present invention.

FIG. 2 is a magnified cross-sectional view of the fixing surface reformer 103 according to an embodiment of the present invention.

Figure 3:
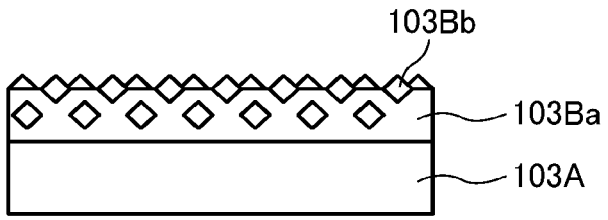
FIG. 3 is a partial magnified view of the fixing surface reformer illustrated in FIG. 3.

FIG. 3 is a partial magnified view of the fixing surface reformer 103 illustrated in FIG. 2.

The fixing surface reformer 103 reforms the surface of the fixing belt 26. The fixing surface reformer 103 comprises a core 103A and an abutting layer 103B covering the outer circumferential surface of the core 103A. The fixing surface reformer 103 is disposed movable between a rubbing position where the fixing surface reformer 103 rubs against the fixing belt 26 and a separated position separated away from the rubbing position.

The abutting layer 103B comprises a binder 103Ba, such as a rubber or a resin, and abrasive grains 103Bb dispersed in the binder 103Ba.

Examples of the binder 103Ba include a silicone rubber and a fluororesin, but are not limited thereto.

The abrasive grains 103Bb have an average grain size of from 2.0 to 6.5 μm and may be made of white alumina, brown alumina, crushed type alumina, pink alumina, green silicon carbide, black silicon carbide, diamond, or CBN (cubic boron nitride).

By rubbing against the fixing belt 26, the fixing surface reformer 103 exerts functions of uniformly roughening the surface of the fixing belt 26 or removing foreign matter from the fixing belt 26. The fixing surface reformer 103 also has functions of scraping, crushing, and softening the surface of the fixing belt 26, adsorbing foreign matter on the surface of the fixing belt 26, and applying a coating agent or the like to the surface of the fixing belt 26.

In the present embodiment, the fixing surface reformer 103 comes into contact with the fixing belt 26 and rotates to polish the fixing belt 26, in response to an operation of the operation unit of the image forming apparatus or an automatic control conducted after image formation, as glossy streak is recognized on the edge portion of the recording medium due to roughness on the surface of the fixing belt 26 conforming to the edge of the recording medium width that has become apparent after the continuous passage of the recording medium. The fixing surface reformer 103 rotates in the same direction as the fixing belt 26 rotates at a linear velocity 3 to 8 times that of the fixing belt 26 to polish the fixing belt 26.

Toner

The toner contains a crystalline polyester resin.

The toner exhibits a storage elastic modulus G' of $1.0\times10^7$ Pa or lower, preferably from $5.0\times10^5$ to $1.0\times10^7$ Pa, at 70° C. in a temperature rising in a viscoelasticity measurement.

The toner exhibits a storage elastic modulus G' of $1.0\times10^7$ Pa or higher, preferably from $1.0\times10^7$ to $5.0\times10^8$ Pa, at 70° C. in a temperature falling in the viscoelasticity measurement.

The toner exhibits an endothermic peak derived from the crystalline polyester resin indicating an amount of heat absorption of from 2.0 to 8.0 J/g, preferably from 3.0 to 5.0 J/g, in a first temperature rising in a differential scanning calorimetry (DSC).

Preferably, the toner exhibits a glass transition temperature (Tg1st) of from 45° C. to 65° C. in the first temperature rising in the differential scanning calorimetry (DSC).

Preferably, tetrahydrofuran (THF)-insoluble matter of the toner exhibits a glass transition temperature (Tg1st) of from −45° C. to 10° C. in the first temperature rising in the DSC. Preferably, THF-soluble matter of the toner exhibits a glass transition temperature (Tg2nd) of from 30° C. to 55° C. in a second temperature rising in the DSC.

Preferably, the THF-insoluble matter comprises a polyester resin. A component attributable to the glass transition temperature (Tg1st) in the first temperature rising in the DSC is denoted as a polyester resin component A.

In the THF-soluble matter of the toner, a component attributable to the glass transition temperature (Tg2nd) in the second temperature rising in the DSC is denoted as a polyester resin component C.

The polyester resin component A may be mainly derived from an amorphous polyester resin having a large weight average molecular weight (Mw) of from 100,000 to 200,000. The polyester resin component C soluble in THF may be mainly derived from an amorphous polyester resin having a weight average molecular weight (Mw) of from 3,000 to 10,000.

The polyester resin component A imparts plasticity to the toner. The polyester resin component A insoluble in tetrahydrofuran (THF) lowers Tg and melt viscosity of the toner while securing low-temperature fixability of the toner. On the other hand, the polyester resin component A has a branched structure in its molecular framework and thus the molecular chain thereof takes a three-dimensional network structure. Therefore, the polyester resin component A exhibits rubber-like property of being deformable but not flowable at low temperatures.

However, when the amount of the polyester resin component A is too large, Tg is lowered and storage stability is not secured. In addition, stress resistance of the toner deteriorates. Thus, a fluidizer on the surface of the toner is embedded in the toner due to thermal or mechanical stress under stirring in the developing device, increasing the adhesion force of the toner particles. As a result, there arise a concern that an abnormal image such as a roughened image may occur in the transfer process. When the amount of the polyester resin component A is too small, impartation of plasticity is insufficient and low-temperature fixability is unsatisfactory. Further, there arise a concern that necessary elasticity is not imparted, thereby degrading high-temperature offset resistance, narrowing the fixable region, and excessively increasing image gloss.

Polyester Resin Component A Insoluble in Tetrahydrofuran (THF)

Preferably, the polyester resin component A comprises a polyol component and a polycarboxylic acid component, and the polyol component is a diol component.

The polycarboxylic acid component may be, for example, a dicarboxylic acid component.

Examples of the diol component include, but are not limited to, aliphatic diols having 3 to 10 carbon atoms.

Specific examples of the aliphatic diols having 3 to 10 carbon atoms include, but are not limited to, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, and 1,10-decanediol.

The content of the aliphatic diol having 3 to 10 carbon atoms in the diol component is preferably 50% by mol or more, more preferably 80% by mol or more.

Preferably, the diol component of the polyester resin component A has a main chain containing carbon atoms in an odd number of from 3 to 9 and a side chain containing an alkyl group. Preferably, the diol component is represented by the following general formula (1).

$$HO—(CR_1R_2)_n—OH \qquad \text{General Formula (1)}$$

In the general formula (1), each of $R_1$ and $R_2$ independently represents a hydrogen atom or an alkyl group having 1 to 3 carbon atoms. n represents an odd number of from 3 to 9. In the repeating units in the number of n, $R_1$ and $R_2$ may be either the same or different.

It is preferable that the polyester resin component A comprises a cross-linking component. Preferably, the cross-linking component comprises an aliphatic alcohol having a valence of 3 or more. For glossiness and image density of the fixed image, the polyester resin component A preferably comprises a trivalent or tetravalent aliphatic alcohol as a constituent. Preferred examples of the trivalent or tetravalent aliphatic alcohol include trivalent or tetravalent aliphatic polyols having 3 to 10 carbon atoms. Alternatively, the cross-linking component may be comprised only of the aliphatic alcohol having a valence of 3 or more.

The aliphatic alcohol having a valence of 3 or more can be appropriately selected according to the purpose. Examples thereof include, but are not limited to, glycerin, trimethylolethane, trimethylolpropane, pentaerythritol, sorbitol, and dipentaerythritol. Each of these aliphatic alcohols having a valence of 3 or more may be used alone or in combination with others.

Also, the cross-linking component of the polyester resin component A may comprise a carboxylic acid having a valence of 3 or more or an epoxy compound. However, the aliphatic alcohol having a valence of 3 or more is more preferable as the cross-linking component for suppressing unevenness and achieving sufficient glossiness and image density.

The proportion of the cross-linking component in the polyester resin component A is not particularly limited and may be appropriately selected depending on the purpose, but is preferably from 0.5% to 5% by mass, more preferably from 1% to 3% by mass.

The proportion of the aliphatic alcohol having a valence of 3 or more in the polyol component of the polyester resin component A is not particularly limited and may be appropriately selected depending on the purpose, but is preferably from 50% to 100% by mass, more preferably from 90% to 100% by mass.

Preferably, the dicarboxylic acid component of the polyester resin component A comprises an aliphatic dicarboxylic acid having 4 to 12 carbon atoms. More preferably, the dicarboxylic acid component comprises the aliphatic dicarboxylic acid having 4 to 12 carbon atoms in an amount of 50% by mol or more.

Specific examples of the aliphatic dicarboxylic acid having 4 to 12 carbon atoms include, but are not limited to, succinic acid, glutaric acid, adipic acid, pimelic acid, suberic acid, azelaic acid, sebacic acid, and dodecanedioic acid.

Preferably, the polyester resin component A has at least one of urethane bond and urea bond for exhibiting excellent adhesion property to recording media such as paper. In this case, urethane bond and/or urea bond behave as pseudo cross-linked points, thereby enhancing rubber property of the polyester resin component A and improving heat-resistant storage stability and high-temperature offset resistance of the toner.

The molecular weight of the polyester resin component A is not particularly limited and may be appropriately selected depending on the purpose. For heat-resistant storage stability, durability against stress such as stirring in a developing device, and low-temperature fixability of the toner, the weight average molecular weight (Mw) of the polyester resin component A, measured by gel permeation chromatography (GPC), is preferably from 100,000 to 200,000.

For heat-resistant storage stability, durability against stress such as stirring in a developing device, filming resistance, and low-temperature fixability of the toner, Tg of the polyester resin component A is preferably from −50° C. to 0° C., more preferably from −40° C. to −20° C.

Polyester Resin Component C Soluble in Tetrahydrofuran (THF)

Preferably, the polyester resin component C comprises a diol component and a dicarboxylic acid component. More preferably, the polyester resin component C comprises an alkylene glycol in an amount of 40% by mol or more. The polyester resin component C may or may not comprise a cross-linking component.

Preferably, the polyester resin component C is a linear polyester resin.

In addition, preferably, the polyester resin component C is an unmodified polyester resin. Here, the unmodified polyester resin refers to a polyester resin that is obtained from a polyol and a polycarboxylic acid or derivative thereof (e.g., a polycarboxylic acid anhydride, a polycarboxylic acid ester) and is unmodified with an isocyanate compound or the like.

Examples of the polyol include, but are not limited to, diols.

Specific examples of the diols include, but are not limited to, alkylene (C2-C3) oxide adducts of bisphenol A with an average addition molar number of 1 to 10 (e.g., polyoxypropylene(2.2)-2,2-bis(4-hydroxyphenyl)propane, polyoxyethylene(2.2)-2,2-bis(4-hydroxyphenyl)propane), ethylene glycol, propylene glycol, hydrogenated bisphenol A, and alkylene (C2-C3) oxide adducts of hydrogenated bisphenol A with an average addition molar number of 1 to 10.

Each of these materials can be used alone or in combination with others.

Examples of the polycarboxylic acid include, but are not limited to, dicarboxylic acids.

Specific examples of the dicarboxylic acids include, but are not limited to: adipic acid, phthalic acid, isophthalic acid, terephthalic acid, fumaric acid, and maleic acid; and succinic acid derivatives substituted with an alkyl group having 1 to 20 carbon atoms or an alkenyl group having 2 to 20 carbon atoms, such as dodecenyl succinic acid and octyl succinic acid. In particular, the polycarboxylic acid comprises terephthalic acid in an amount of 50% by mol or more.

Each of these materials can be used alone or in combination with others.

The polyester resin component C may comprise a carboxylic acid having a valence of 3 or more and/or an alcohol having a valence of 3 or more on a terminal of the resin chain for the purpose of adjusting acid value and/or hydroxyl value.

Specific examples of the carboxylic acid having a valence of 3 or more include, but are not limited to, trimellitic acid, pyromellitic acid, and anhydrides thereof.

Specific examples of the alcohol having a valence of 3 or more include, but are not limited to, glycerin, pentaerythritol, and trimethylolpropane.

It is preferable that the polyester resin component C comprises a cross-linking component. Preferably, the cross-linking component comprises an aliphatic alcohol having a valence of 3 or more. For glossiness and image density of the fixed image, the polyester resin component C preferably comprises a trivalent or tetravalent aliphatic alcohol as a constituent. Preferred examples of the trivalent or tetravalent aliphatic alcohol include trivalent or tetravalent aliphatic polyols having 3 to 10 carbon atoms. Alternatively, the cross-linking component may be comprised only of the aliphatic alcohol having a valence of 3 or more.

The aliphatic alcohol having a valence of 3 or more can be appropriately selected according to the purpose. Examples thereof include, but are not limited to, glycerin, trimethylolethane, trimethylolpropane, pentaerythritol, sorbitol, and dipentaerythritol. Each of these aliphatic alcohols having a valence of 3 or more may be used alone or in combination with others.

Also, the cross-linking component of the polyester resin component C may comprise a carboxylic acid having a valence of 3 or more or an epoxy compound. However, the aliphatic alcohol having a valence of 3 or more is more preferable as the cross-linking component for suppressing unevenness and achieving sufficient glossiness and image density.

The molecular weight of the polyester resin component C is not particularly limited and may be appropriately selected depending on the purpose. For heat-resistant storage stability, durability against stress such as stirring in a developing device, and low-temperature fixability of the toner, the weight average molecular weight (Mw) and the number average molecular weight (Mn) of the polyester resin component C, measured by gel permeation chromatography (GPC), are preferably in a range of from 3,000 to 10,000 and in a range of from 1,000 to 4,000, respectively. The ratio Mw/Mn is preferably from 1.0 to 4.0. More preferably, the weight average molecular weight (Mw) is from 4,000 to 7,000, the number average molecular weight (Mn) is from 1,500 to 3,000, and the ratio Mw/Mn is from 1.0 to 3.5.

Further, the content of components having a molecular weight of 600 or less in the THF-soluble matter is preferably from 2% to 10% by mass. The polyester resin component C may be purified by being extracted with methanol to remove components having a molecular weight of 600 or less.

The acid value of the polyester resin component C is not particularly limited and may be appropriately selected according to the purpose, but is preferably from 1 to 50 mgKOH/g, and more preferably from 5 to 30 mgKOH/g. When the acid value is 1 mgKOH/g or higher, the toner becomes more negatively-chargeable and more compatible with paper when being fixed thereon, thereby improving low-temperature fixability.

The hydroxyl value of the polyester resin component C is not particularly limited and may be appropriately selected depending on the purpose, but it is preferably 5 mgKOH/g or higher.

For heat-resistant storage stability, durability against stress such as stirring in a developing device, and low-temperature fixability of the toner, Tg of the polyester resin component C is preferably from 45° C. to 65° C., more preferably from 50° C. to 60° C.

The content of the polyester resin component C in 100 parts by mass of the toner is preferably from 80 to 90 parts by mass, more preferably 80 parts by mass. In a three-component system including the polyester resin component A, a polyester resin component B, and the polyester resin component C, when the content of the polyester resin component C is 80 parts by mass or more, separation of the polyester resin component A and the polyester resin component B from each other, deterioration of dispersibility of the colorant in the toner, and lowering of coloring power of the toner are all prevented.

Here, the polyester resin component B may be a THF-insoluble component having a Tg1st different from that of the polyester resin component A. The composition of the polyester resin component B may be the same as that of the polyester resin component A.

Polyester Resin Having Urethane Bond and/or Urea Bond

The polyester resin having urethane bond and/or urea bond is not particularly limited and may be appropriately selected depending on the purpose. Examples thereof include a reaction product of a polyester resin having an active hydrogen group with a polyisocyanate, but are not limited thereto. This reaction product is preferably used as a reaction precursor (hereinafter may be "prepolymer") to be reacted with a curing agent described later.

Examples of the polyester resin having an active hydrogen group include a polyester resin having hydroxyl group, but are not limited thereto.

Polyisocyanate

The polyisocyanate is not particularly limited and may be appropriately selected depending on the purpose. Examples of the polyisocyanate include, but are not limited to, diisocyanates and isocyanates having a valence of 3 or more.

Specific examples of the diisocyanates include, but are not limited to, aliphatic diisocyanates, alicyclic diisocyanates, aromatic diisocyanates, aromatic aliphatic diisocyanates, isocyanurates, and these diisocyanates blocked with a phenol derivative, oxime, or caprolactam.

Specific examples of the aliphatic diisocyanates include, but are not limited to, tetramethylene diisocyanate, hexamethylene diisocyanate, 2,6-diisocyanatocaproic acid methyl ester, octamethylene diisocyanate, decamethylene diisocyanate, dodecamethylene diisocyanate, tetramethylene diisocyanate, trimethylhexane diisocyanate, and tetramethylhexane diisocyanate.

Specific examples of the alicyclic diisocyanates include, but are not limited to, isophorone diisocyanate and cyclohexylmethane diisocyanate.

Specific examples of the aromatic diisocyanates include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

Specific examples of the aromatic aliphatic diisocyanates include, but are not limited to, α,α,α',α'-tetramethylxylylene diisocyanate.

Specific examples of the isocyanurates include, but are not limited to, tris(isocyanatoalkyl) isocyanurate and tris (isocyanatocycloalkyl) isocyanurate.

Each of these polyisocyanates can be used alone or in combination with others.

Curing Agent

The curing agent is not particularly limited as long as it reacts with the prepolymer and can be appropriately selected according to the purpose. Examples of the curing agent include, but are not limited to, compounds having an active hydrogen group.

Compound Having Active Hydrogen Group

The active hydrogen group in the compound is not particularly limited and may be appropriately selected according to the purpose. Specific examples of the active hydrogen group in the compound include, but are not limited to, hydroxyl groups (e.g., alcoholic hydroxyl group, phenolic hydroxyl group), amino group, carboxyl group, and mercapto group. Each of these active hydrogen groups may be used alone or in combination with others.

Preferably, the compound having an active hydrogen group is an amine, because amines are capable of forming urea bond.

Examples of the amines include, but are not limited to, diamines, amines having a valence of 3 or more, amino alcohols, amino mercaptans, and amino acids, and these amines in which the amino group is blocked. Each of these materials can be used alone or in combination with others.

In particular, a diamine alone and a mixture of a diamine with a small amount of an amine having a valence of 3 or more are preferable.

Examples of the diamines include, but are not limited to, aromatic diamines, alicyclic diamines, and aliphatic diamines. Specific examples of the aromatic diamines include, but are not limited to, phenylenediamine, diethyltoluenediamine, and 4,4'-diaminodiphenylmethane. Specific examples of the alicyclic diamines include, but are not limited to, 4,4'-diamino-3,3'-dimethyldicyclohexylmethane, diaminocyclohexane, and isophoronediamine. Specific examples of the aliphatic diamines include, but are not limited to, ethylenediamine, tetramethylenediamine, and hexamethylenediamine.

Specific examples of the amines having a valence of 3 or more include, but are not limited to, diethylenetriamine and triethylenetetramine.

Specific examples of the amino alcohols include, but are not limited to, ethanolamine and hydroxyethylaniline.

Specific examples of the amino mercaptans include, but are not limited to, aminoethyl mercaptan and aminopropyl mercaptan.

Specific examples of the amino acids include, but are not limited to, aminopropionic acid and aminocaproic acid.

Specific examples of the amines in which the amino group is blocked include, but are not limited to, ketimine compounds in which the amino group is blocked with a ketone such as acetone, methyl ethyl ketone, and methyl isobutyl ketone; and oxazoline compounds.

The molecular structure of the polyester resin components A, B, and C can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a polyester resin as a substance showing no absorption peak based on δCH (out-of-plane bending vibration) of olefin at 965±10 $cm^{-1}$ and 990±10 $cm^{-1}$ in an infrared absorption spectrum.

Crystalline Polyester Resin D

A crystalline polyester resin D (hereinafter simply "crystalline polyester resin") is described in detail below. The crystalline polyester resin has a heat melting property such that the viscosity rapidly decreases at around the fixing start temperature due to its high crystallinity. When used in combination with the polyester resin, the crystalline polyester resin can maintain good storage stability below the melting start temperature due to its crystallinity, but upon reaching the melting start temperature, the crystalline polyester resin melts while rapidly reducing its viscosity ("sharply-melting property"). The crystalline polyester resin then compatibilizes with the polyester resin and together rapidly reduces viscosity to be fixed on a recording medium. Thus, the toner exhibits excellent heat-resistant storage stability and low-temperature fixability. Such a toner also exhibits a wide releasable range (i.e., the difference between the lowest fixable temperature and the high-temperature offset generating temperature).

The crystalline polyester resin is obtained from a polyol and a polycarboxylic acid or derivative thereof, such as a polycarboxylic acid anhydride and a polycarboxylic acid ester.

In the present disclosure, the crystalline polyester resin refers to a resin obtained from a polyol and a polycarboxylic acid or derivative thereof, such as a polycarboxylic acid anhydride and a polycarboxylic acid ester. Modified polyester resins, such as the prepolymer described above and resins obtained by cross-linking and/or elongating the prepolymer, do not fall within the crystalline polyester resin of the present disclosure.

Whether the crystalline polyester resin has crystallinity or not can be confirmed by a crystal analysis X-ray diffractometer (e.g., X'PERT PRO MRD from Koninklijke Philips N.V.). A measurement method is described below.

First, a target sample is ground by a mortar to prepare a sample powder, and the obtained sample powder is uniformly applied to a sample holder. The sample holder is set in the diffractometer, and a measurement is performed to obtain a diffraction spectrum. It is determined that the sample has crystallinity when the half value width of the diffraction peak having the highest peak intensity among the diffraction peaks observed in the range of $20° < 2\theta < 25°$ is 2.0 or less.

In the present disclosure, a polyester resin which does not satisfy this condition is referred to as an amorphous polyester resin in contrast to the crystalline polyester resin.

Exemplary measurement conditions for X-ray diffraction are described below.

Measurement Conditions
Tension kV: 45 kV
Current: 40 mA
MPSS
Upper
Gonio
Scanmode: continuos
Start angle: 3°
End angle: 35°
Angle Step: 0.02°
Lucident beam optics
Divergence slit: Div slit ½
Diffraction beam optics
Anti scatter slit: As Fixed ½
Receiving slit: Prog rec slit Polyol The polyol is not particularly limited and may be appropriately selected depending on the purpose. Examples of the polyol include, but are not limited to, diols and alcohols having a valence of 3 or more.

Examples of the diols include, but are not limited to, saturated aliphatic diols. Examples of the saturated aliphatic diols include, but are not limited to, straight-chain saturated aliphatic diols and branched saturated aliphatic diols. In particular, straight-chain saturated aliphatic diols are preferable, and straight-chain saturated aliphatic diols having 2 to 12 carbon atoms are more preferable. Thus, the number of carbon atoms is preferably 12 or less.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these diols, ethylene glycol, 1,4-butanediol, 1,6-hexanediol, 1,8-octanediol, 1,10-decanediol, and 1,12-dodecanediol are preferable for obtaining a crystalline polyester resin having high crystallinity and sharply-melting property.

Specific examples of the alcohols having a valence of 3 or more include, but are not limited to, glycerin, trimethylolethane, trimethylolpropane, and pentaerythritol. Each of these compounds can be used alone or in combination with others.

Polycarboxylic Acid

The polycarboxylic acid is not particularly limited and may be appropriately selected according to the purpose. Examples of the polycarboxylic acid include, but are not limited to, divalent carboxylic acids and carboxylic acids having a valence of 3 or more.

Specific examples of the dicarboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, and mesaconic acid; and anhydrides and lower alkyl esters (C1-C3) thereof.

Specific examples of the carboxylic acids having a valence of 3 or more include, but are not limited to, 1,2,4-benzenetricarboxylic acid, 1,2,5-benzenetricarboxylic acid, 1,2,4-naphthalenetricarboxylic acid, and anhydrides and lower alkyl esters (C1-C3) thereof.

The polycarboxylic acid may further include a dicarboxylic acid having sulfonic acid group, other than the above-described saturated aliphatic dicarboxylic acids and aromatic dicarboxylic acids. In addition, the polycarboxylic acid may further include a dicarboxylic acid having a double bond, other than the above-described saturated aliphatic dicarboxylic acids and aromatic dicarboxylic acids. Each of these compounds can be used alone or in combination with others.

Preferably, the crystalline polyester resin comprises a straight-chain saturated aliphatic dicarboxylic acid having 4 to 12 carbon atoms and a straight-chain saturated aliphatic diol having 2 to 12 carbon atoms. In other words, preferably, the crystalline polyester resin has a structural unit derived from a saturated aliphatic dicarboxylic acid having 4 to 12 carbon atoms and another structural unit derived from a saturated aliphatic diol having 2 to 12 carbon atoms. Such a crystalline polyester resin has high crystallinity and sharply-melting property and thus exerts excellent low-temperature fixability, which is preferable.

The melting point of the crystalline polyester resin is not particularly limited and may be appropriately selected according to the purpose, but is preferably in the range of from 60° C. to 80° C.

The molecular weight of the crystalline polyester resin is not particularly limited and may be appropriately selected depending on the purpose. As the molecular weight distribution becomes narrower and the molecular weight becomes lower, low-temperature fixability improves. As the amount of low-molecular-weight components decreases, heat-resistant storage stability becomes more excellent. In view of this, preferably, ortho-dichlorobenzene-soluble matter in the crystalline polyester resin has a weight average molecular weight (Mw) of from 3,000 to 30,000 and a number average molecular weight (Mn) of from 1,000 to 10,000, and a ratio Mw/Mn of from 1.0 to 10, when measured by GPC (gel permeation chromatography). More preferably, the weight average molecular weight (Mw) is from 5,000 to 15,000, the number average molecular weight (Mn) is from 2,000 to 10,000, and the ratio Mw/Mn is from 1.0 to 5.0.

The acid value of the crystalline polyester resin is not particularly limited and may be appropriately selected according to the purpose, but is preferably 5 mgKOH/g or more, more preferably 10 mgKOH/g or more, for achieving a desired level of low-temperature fixability in terms of affinity for paper. On the other hand, for improving high-temperature offset resistance, the acid value is preferably 45 mgKOH/g or less.

The hydroxyl value of the crystalline polyester resin is not particularly limited and may be appropriately selected according to the purpose, but is preferably in the range of from 0 to 50 mgKOH/g, more preferably from 5 to 50 mgKOH/g, for achieving a desired level of low-temperature fixability and a good level of charge property.

The molecular structure of the crystalline polyester resin can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a crystalline polyester resin as a substance showing an absorption peak based on SCH (out-of-plane bending vibration) of olefin at 965±10 $cm^{-1}$ or 990±10 $cm^{-1}$ in an infrared absorption spectrum.

The content of the crystalline polyester resin in the toner is not particularly limited and may be appropriately selected according to the purpose. Preferably, the content of the crystalline polyester resin in 100 parts by mass of the toner is in the range of from 1 to 10 parts by mass, more preferably from 2 to 4 parts by mass, for preventing image fog and improving low-temperature fixability and heat-resistant storage stability. When the content is within the preferred range, all properties such as image quality and low-temperature fixability are excellent.

Other Components

The toner according to an embodiment of the present invention may further contain other components such as a release agent, a colorant, a charge control agent, an external additive, a fluidity improving agent, a cleanability improving agent, and a magnetic material.

Release Agent

The release agent is not limited to any particular material and can be selected from known materials.

Specific examples of the release agent include, but are not limited to, waxes, particularly natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, microcrystalline wax, petrolatum wax).

In addition to these natural waxes, synthetic hydrocarbon waxes (e.g., Fischer-Tropsch wax, polyethylene wax, polypropylene wax) and synthetic waxes (e.g., ester wax, ketone wax, ether wax) may also be used.

Furthermore, the following materials are also usable as the release agent: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers, such as copolymer of n-stearyl acrylate and ethyl methacrylate; and crystalline polymers having a long alkyl side chain.

Among these materials, hydrocarbon waxes such as paraffin wax, micro-crystalline wax, Fischer-Tropsch wax, polyethylene wax, and polypropylene wax are preferable.

The melting point of the release agent is not particularly limited and may be appropriately selected according to the purpose, but is preferably from 60° C. to 80° C.

The content of the release agent in the toner is not particularly limited and may be appropriately selected according to the purpose, but is preferably from 2 to 10 parts by mass, more preferably from 3 to 8 parts by mass, based on 100 parts by mass of the toner. When the content is within the preferred range, image quality and fixing stability are advantageously improved.

Colorant

The colorant is not particularly limited and may be appropriately selected depending on the purpose.

Specific examples of the colorant include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The content of the colorant in the toner is preferably from 1 to 15 parts by mass, more preferably from 3 to 10 parts by mass, based on 100 parts by mass of the toner.

The colorant can be combined with a resin to be used as a master batch. Specific examples of the resin to be used for the master batch include, but are not limited to, the above-described other polyester resin, polymers of styrene or a derivative thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax.

Each of these materials can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Charge Control Agent

The charge control agent is not particularly limited and may be appropriately selected depending on the purpose. Specific examples of the charge control agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge control agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), all available from Japan Carlit Co., Ltd.; and cooper phthalocyanine, perylene, quinacridone, azo pigments, and polymers having a functional group such as a sulfonic acid group, a carboxyl group, and a quaternary ammonium group.

The content of the charge control agent in the toner is preferably from 0.1 to 10 parts by mass, more preferably from 0.2 to 5 parts by mass, based on 100 parts by mass of the toner. The charge control agent may be melt-kneaded with the master batch or the binder resin and thereafter dissolved or dispersed in an organic solvent, or directly dissolved or dispersed in an organic solvent. Alternatively, the charge control agent may be fixed on the surface of the resulting toner particles.

External Additive

The external additive is not particularly limited and may be appropriately selected depending on the purpose. Examples of the external additives include, but are not limited to, various types of fine inorganic particles and fine hydrophobized inorganic particles. In addition, fatty acid metal salts (e.g., zinc stearate, aluminum stearate) and fluoropolymers may also be used.

Specific examples of the fine inorganic particles include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferable.

Specific preferred examples of the external additive include, but are not limited to, fine particles of hydrophobized silica, titania, titanium oxide, and alumina. Specific examples of commercially-available fine particles of silica include, but are not limited to, R972, R974, RX200, RY200, R202, R805, and R812 (available from Nippon Aerosil Co., Ltd.). Specific examples of commercially-available fine particles of titania include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially-available fine particles of hydrophobized titanium oxide include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The fine particles of hydrophobized oxides, hydrophobized silica, hydrophobized titania, and hydrophobized alumina can be obtained by treating fine particles of oxides, silica, titania, and alumina, respectively, which are hydrophilic, with a silane coupling agent such as methyltrimethoxysilane, methyltriethoxysilane, and octyltrimethoxysilane. In addition, fine particles of oxides and fine inorganic particles which are treated with a silicone oil, optionally upon application of heat, are also preferable.

Specific examples of the silicone oil include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

The average particle diameter of primary particles of the fine inorganic particles is not particularly limited and may be appropriately selected according to the purpose, but is preferably 100 nm or less, more preferably from 3 to 70 nm.

The average particle diameter of primary particles of the fine hydrophobized inorganic particles is preferably from 1 to 100 nm, more preferably from 5 to 70 nm. Preferably, the external additive includes at least one type of fine inorganic particles the primary particles of which having an average particle diameter of 20 nm or less, and at least one type of fine inorganic particles the primary particles of which having an average particle diameter of 30 nm or more. Preferably, the BET specific surface area thereof is from 20 to 500 $m^2/g$.

The content of the external additive in the toner is preferably from 0.1 to 5 parts by mass, more preferably from 0.3 to 3 parts by mass, based on 100 parts by mass of the toner.

Fluidity Improving Agent

The fluidity improving agent is not particularly limited and can be appropriately selected according to the purpose as long as it is capable of increasing hydrophobicity by surface treatment and preventing deterioration of fluidity and charge property even under high humidity conditions. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with such a fluidity improving agent to become hydrophobic silica and hydrophobic titanium oxide, respectively.

Cleanability Improving Agent

The cleanability improving agent is added to the toner so that the developer remaining on a photoconductor or a primary transfer medium without being transferred is removable. The cleanability improving agent is not particularly limited and can be appropriately selected according to the purpose. Specific examples of the cleanability improving agent include, but are not limited to: metal salts of fatty acids, such as zinc stearate and calcium stearate; and fine particles of polymers prepared by soap-free emulsion polymerization, such as fine polymethyl methacrylate particles and fine polystyrene particles. Preferably, the particle size distribution of the fine particles of polymers is as narrow as possible. More preferably, the volume average particle diameter thereof is in the range of from 0.01 to 1 μm.

Magnetic Material

The magnetic material is not particularly limited and may be appropriately selected depending on the purpose. Specific examples of usable magnetic materials include, but are not limited to, iron powder, magnetite, and ferrite. In particular, those having white color tone are preferable.

Glass Transition Temperature (Tg1st)

Preferably, the toner exhibits a glass transition temperature (Tg1st) of from 45° C. to 65° C., more preferably from 50° C. to 60° C., in the first temperature rising in the differential scanning calorimetry (DSC). When Tg1st is 45° C. or higher, toner aggregation is less likely to occur when the toner is transported in summer season or in tropical regions or stored under a temperature-variable environment. As a result, solidification of the toner in a toner bottle and adherence of the toner to the inside of a developing device can be prevented. In addition, either defective toner supply due to toner clogging in the toner bottle or an abnormal image due to toner adhesion to the developing device are less likely to occur. When Tg1st is 65° C. or less, low-temperature fixability is good.

The glass transition temperature (Tg1st) of the toner measured in the first temperature rising in the DSC can be adjusted to be within a desired range by changing the constitutional ratio between the aliphatic diol and the dicarboxylic acid in the polyester resin component A, the glass transition temperature of the polyester resin component B, the glass transition temperature of the polyester resin component C, and/or the constitutional ratio among the polyester resin component A, the polyester resin component B, and the polyester resin component C.

Volume Average Particle Diameter

The volume average particle diameter of the toner according to an embodiment of the present invention is not particularly limited and may be appropriately selected according to the purpose, but is preferably from 3 to 7 μm. In addition, preferably, the ratio of the volume average particle diameter to the number average particle diameter is 1.2 or less. Furthermore, preferably, the toner contains toner particles having a volume particle diameter of 2 μm or less in an amount of from 1% to 10% by number.

Calculation Methods and Analysis Methods of Various Properties of Toner and Toner Constituents Next, calculation methods and analysis methods of various properties of the toner and toner constituents are described below. Various properties such as glass transition temperature (Tg), acid value, hydroxyl value, molecular weight, and melting point of toner constituents, such as the polyester resin components A, B, and C, the crystalline polyester resin, and the release agent, may be measured from the single body thereof. Alternatively, such properties may be measured from each constituent separated (isolated) from the toner by means of Soxhlet extraction, gel permeation chromatography (GPC), or the like. In the present embodiment, a means for separating each constituent from the toner can be arbitrarily selected. The glass transition temperature (Tg) of a target sample is measured by a method described below.

As an example, a method for measuring the glass transition temperatures of the polyester resin component A, polyester resin component B, and polyester resin component C in the toner is described below. First, 1 g of the toner is put into 100 mL of THF and subjected to Soxhlet extraction, thus obtaining a THF-soluble matter and a THF-insoluble matter. The THF-soluble matter and the THF-insoluble matter are dried in a vacuum dryer for 24 hours, thus obtaining a mixture of the polyester resin component C and the crystalline polyester resin component from the THF soluble matter and a mixture of the polyester resin component A and the polyester resin component B from the THF-insoluble matter. The glass transition temperatures are measured by the method described later from these mixtures, i.e., target samples.

Since the polyester resin component A and the polyester resin component B have different glass transition temperatures, the glass transition temperature of each of the polyester resin component A and the polyester resin component B can be determined by measuring the glass transition temperature of the above-obtained mixture of the polyester resin component A and the polyester resin component B.

As another example, first, 1 g of the toner is put in 100 mL of THF and stirred at 25° C. for 30 minutes to obtain a solution in which THF-soluble matter is dissolved. The solution is filtered with a membrane filter having an opening of 0.2 μm to separate (isolate) THF-soluble matter from the toner. The THF-soluble matter is dissolved in THF to prepare a sample for GPC measurement. The sample is injected into a GPC instrument for measuring the molecular weight of the polyester resin component C. On the other hand, THF-insoluble matter in the toner is used as a sample for measuring the molecular weights of the polyester resin component A and the polyester resin component B by GPC.

A fraction collector, disposed at the eluate discharge port of the GPC instrument, collects a fraction of the eluate at every predetermined count. Every time the collected fractions correspond to 5% of the area of the elution curve (from the rising of the curve), the collected fractions are separated. Each separated eluate in an amount of 30 mg is dissolved in 1 mL of deuterated chloroform. As a standard substance, 0.05% by volume of tetramethylsilane (TMS) is further added thereto. The resulting solution is poured in a glass tube having a diameter of 5 mm and subjected to an NMR measurement using a nuclear magnetic resonance spectrometer (JNM-AL400 available from JEOL Ltd.) to obtain a spectrum. The measurement is performed at a temperature of from 23° C. to 25° C., and the number of accumulation is 128. The monomer composition and constitutional ratio of the toner constituents, such as the polyester resin components A, B, and C and the crystalline polyester resin, can be determined from the peak integral ratio of the spectrum.

Next, a method for separating each constituent by GPC is described below. In a GPC measurement using THF as a mobile phase, the eluate is divided into fractions by a fraction collector, and the fractions corresponding to the desired molecular weight portion in the total area of the elution curve are collected. The collected fractions of the eluate are condensed and dried by an evaporator or the like. The resulting solid is dissolved in a deuterated solvent, such as deuterated chloroform or deuterated THF, and subjected to $^{1}$H-NMR measurement to determine integrated ratio of each element and calculate the constitutional monomer ratio in the eluted components. Alternatively, the constitutional monomer ratio may be determined by hydrolyzing the condensed eluate with sodium hydroxide or the like, and subjecting the decomposition product to a qualitative quantitative analysis by high-performance liquid chromatography (HPLC).

In a case in which the toner is produced by a method including the process of forming a polyester resin by causing an elongation reaction and/or a cross-linking reaction between a non-linear reactive precursor and a curing agent while forming mother toner particles, the polyester resin may be separated from the toner by GPC or the like to determine Tg or the like from the separated polyester resin. Alternatively, the polyester resin may be previously synthesized by causing an elongation reaction and/or a cross-linking reaction between a non-linear reactive precursor and a curing agent, and the properties such as Tg may be determined from the synthesized polyester resin.

Measurement Methods of Melting Point and Glass Transition Temperature (Tg)

In the present embodiment, melting points, glass transition temperatures (Tg), and the amount of heat absorption of the crystalline polyester resin are measured with a DSC (differential scanning calorimeter) system (Q-200 available from TA Instruments).

More specifically, melting points and glass transition temperatures (Tg) are measured in the following manner.

First, about 5.0 mg of a sample is put in an aluminum sample container. The sample container is put on a holder unit and set in an electric furnace. The temperature is raised from −80° C. to 150° C. at a temperature rising rate of 10° C./min ("first temperature rising") in nitrogen atmosphere. The temperature is thereafter lowered from 150° C. to −80° C. at a temperature falling rate of 10° C./min and raised to 150° C. again at a temperature rising rate of 10° C./min ("second temperature rising"). In each of the first temperature rising and the second temperature rising, a DSC curve is obtained by the differential scanning calorimeter (Q-200 available from TA Instruments).

Figure 4:
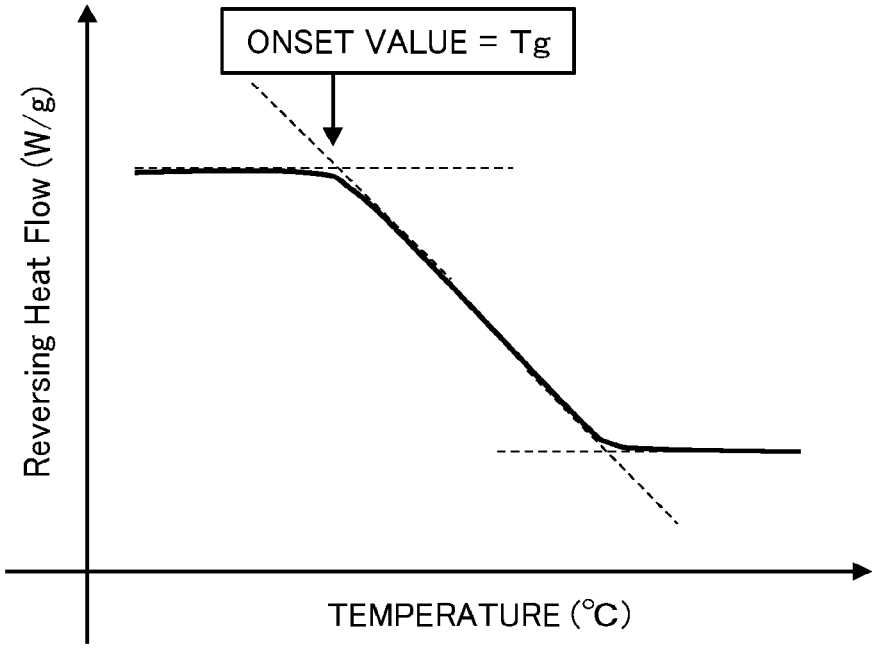
FIG. 4 is a diagram for explaining an onset value.

The obtained DSC curves are analyzed with an analysis program installed in Q-200. By selecting the DSC curve obtained in the first heating, a glass transition temperature Tg1st of the target sample in the first heating can be determined. Similarly, by selecting the DSC curve obtained in the second heating, a glass transition temperature Tg2nd of the target sample in the second heating can be determined. In the present disclosure, the onset value illustrated in FIG. 4 is taken as Tg.

The THF-insoluble matter of the toner is preferably subject to a measurement procedure under the conditions described below in which the temperature is raised with a modulation temperature amplitude. This measurement procedure makes it possible to separate the glass transition temperature (Tg1st) in the first heating into two portions.

(Measurement Conditions)

Using modulation mode, the temperature is raised from −80° C. to 150° C. at a temperature rising rate of 1.0° C./min ("first heating") with a modulation temperature amplitude of ±1.0° C./min. The temperature is thereafter lowered from 150° C. to −80° C. at a temperature falling rate of 10° C./min and raised to 150° C. again at a temperature rising rate of 1.0° C./min ("second heating"). The obtained DSC curves are analyzed with an analysis program installed in Q-200 on the ordinate with "Reversing Heat Flow" as the vertical axis, and the onset value illustrated in FIG. 4 is taken as Tg.

In addition, by selecting the DSC curve obtained in the first temperature rising with an analysis program installed in Q-200, an endothermic peak temperature in the first temperature rising can be determined as a melting point in the first temperature rising. Similarly, by selecting the DSC curve obtained in the second temperature rising, an endothermic peak temperature in the second temperature rising can be determined as a melting point in the second temperature rising.

The endothermic peak derived from the crystalline polyester resin can be determined from the DSC chart of the first temperature rising and the DSC chart of the second temperature rising. When the toner contains a release agent, a clear endothermic peak appears at around the melting point since the release agent has crystallinity like the crystalline polyester resin. The crystalline polyester resin exhibits a clear endothermic peak in the DSC chart of the first temperature rising. On the other hand, in the DSC chart of the second temperature rising, the endothermic peak disappears, the endothermic peak temperature is shifted, or the amount of heat absorption is decreased, because the crystalline structure collapses as the crystalline polyester resin compatibilizes with the polyester resin. The release agent exhibits an endothermic peak in both the first and second temperature risings since the release agent is incompatible with the polyester resin. Therefore, it is possible to determine the endothermic peak derived from the crystalline polyester resin by comparing the DSC chart of the first temperature rising with the DSC chart of the second temperature rising.

The amount of heat absorption indicated by the endothermic peak derived from the crystalline polyester is measured by the following procedure. That is, by selecting the DSC curve obtained in the first temperature rising with an analysis program installed in Q-200, the amount of heat absorption indicated by the endothermic peak derived from the crystalline polyester can be determined.

In the present disclosure, the melting point and the glass transition temperature Tg of each toner constituent, such as the polyester resin components A, B, and C and the release agent, are the endothermic peak temperature and the glass transition temperature Tg2nd, respectively, each measured in the second heating, unless otherwise specified.

Measurement of Storage Elastic Modulus G'

Storage modulus G' under various conditions can be measured by a rheometer (ARES manufactured by TA Instruments). Specifically, a measurement sample is molded into a pellet having a diameter of 8 mm and a thickness of 1 to 2 mm. The pellet is set between parallel plates having a diameter of 8 mm and stabilized at 40° C. The temperature is then raised to 100° C. at a temperature rising rate of 2.0° C./min under a frequency of 1 Hz (6.28 rad/s) and a strain amount of 0.1% (strain amount control mode), and a storage elastic modulus of the sample is measured at 70° C. in the process of temperature rising. The temperature is then lowered to 30° C. at a temperature falling rate of 10.0° C./min under a frequency of 1 Hz (6.28 rad/s) and a strain amount of 1.0% (strain amount control mode), and a storage elastic modulus of the sample is measured at 70° C. in the process of temperature falling.

The storage elastic modulus of the toner at 70° C. in the temperature rising and the storage elastic modulus of the toner at 70° C. in the temperature falling can be adjusted to be within a desired range by changing the constitutional ratio between the aliphatic diol and the dicarboxylic acid in the polyester resin component A, the glass transition temperatures of the polyester resin component A and the polyester resin component C, and/or the constitutional ratio among the polyester resin component A, the polyester resin component B, the polyester resin component C, and the crystalline polyester resin D.

Mass Ratio of Polyester Resin Components

In the present disclosure, the mass ratios a, b, and c of the polyester resin components A, B, and C, respectively, to the total mass of the polyester resin components A, B, and C preferably satisfy the relationship $4(a+b)<c$.

In this case, separation of the resin components is prevented and thereby poor dispersion of the colorant and deterioration of coloring power are prevented. Further, the fixable temperature range and storage stability of the toner can be secured to provide an image with good quality.

In the present embodiment, the mass ratio of each polyester resin component is determined by isolating the combination of the polyester resin components A and B and the combination of the polyester resin component C and the crystalline polyester resin D from the toner by Soxhlet extraction, GPC, or the like, and measuring the weights thereof.

Method for Manufacturing Toner

A method for manufacturing the toner is not particularly limited and may be appropriately selected according to the purpose. Preferably, the toner is manufactured by dispersing an oil phase in an aqueous medium, where the oil phase contains the polyester resin components A, B, and C and optionally the crystalline polyester resin, the release agent, and the colorant.

More preferably, the toner is manufactured by dispersing an oil phase in an aqueous medium, where the oil phase contains a prepolymer of a polyester resin having urethane bond and/or urea bond (as the polyester resin components A and B) and another polyester resin having neither urethane bond nor urea bond (as the polyester resin component C), preferably along with the crystalline polyester resin, and optionally the curing agent, the release agent, and the colorant.

As an example of such a method for manufacturing toner, a dissolution suspension method is known.

As an example thereof, one method is described below that forms mother toner particles while forming a polyester resin by an elongation reaction and/or a cross-linking reaction between the prepolymer and the curing agent.

This method involves the processes of preparation of an aqueous medium, preparation of an oil phase containing toner constituents, emulsification or dispersion of the toner constituents, and removal of an organic solvent.

Preparation of Aqueous Phase

The aqueous phase may be prepared by dispersing resin particles in an aqueous medium. The amount of the resin particles dispersed in the aqueous medium is not particularly limited and may be appropriately selected according to the purpose, but is preferably in the range of from 0.5 to 10 parts by mass based on 100 parts of the aqueous medium.

Specific examples of the aqueous medium include, but are not limited to, water, water-miscible solvents, and mixtures thereof. Each of these materials can be used alone or in combination with others. Among these, water is preferable.

The water-miscible solvent is not particularly limited and may be appropriately selected according to the purpose. Specific examples of the water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oil Phase

The oil phase may be prepared by dissolving or dispersing toner constituents in an organic solvent, where the toner constituents include prepolymers of the polyester resin components A and B having urethane bond and/or urea bond and the polyester resin component C having neither urethane bond nor urea bond, and optionally the crystalline polyester resin, the curing agent, the release agent, and the colorant.

The organic solvent is not particularly limited and may be appropriately selected according to the purpose, but preferred is an organic solvent having a boiling point less than 150° C. that is easy to remove.

Specific examples of the organic solvent having a boiling point less than 150° C. include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

Each of these materials can be used alone or in combination with others.

Among these solvents, ethyl acetate, toluene, xylene, benzene, methylene chloride, 1,2-dichloroethane, chloroform, and carbon tetrachloride are preferable, and ethyl acetate is most preferable.

Emulsification or Dispersion

Emulsification or dispersion of the toner constituents is conducted by dispersing the oil phase containing the toner constituents in the aqueous medium. At the time of emulsification or dispersion of the toner constituents, the curing agent and the prepolymer may undergo an elongation reaction and/or a cross-linking reaction.

The reaction conditions (e.g., reaction time, reaction temperature) for forming the polyester resin components A and B are not particularly limited and can be appropriately determined depending on the combination of the curing agent and the prepolymer. Preferably, the reaction time is in the range of from 10 minutes to 40 hours, more preferably from 2 to 24 hours. Preferably, the reaction temperature is in the range of from 0° C. to 150° C., more preferably from 40° C. to 98° C.

A method for stably forming a dispersion liquid containing the prepolymer in the aqueous medium is not particularly limited and may be appropriately selected depending on the purpose. As an example, the dispersion liquid can be prepared by dispersing the oil phase, in which the toner constituents are dissolved or dispersed in a solvent, in the aqueous medium by a shear force.

A disperser for the dispersing is not particularly limited and may be appropriately selected depending on the purpose. Examples of the disperser include, but are not limited to, low-speed shearing type dispersers, high-speed shearing type dispersers, friction type dispersers, high-pressure jet type dispersers, and ultrasonic dispersers. Among these dispersers, high-speed shearing type dispersers are preferable because they can adjust the particle diameter of the dispersoids (oil droplets) to 2 to 20 μm.

When a high-speed shearing type disperser is used, dispersing conditions, such as the number of rotation, dispersing time, and dispersing temperature, are determined depending on the purpose. The rotation speed is preferably in the range of from 1,000 to 30,000 rpm, and more preferably from 5,000 to 20,000 rpm. The dispersing time is preferably in the range of from 0.1 to 5 minutes in the case of batch-type disperser. The dispersing temperature is preferably in the range of from 0° C. to 150° C., more preferably from 40° C. to 98° C., under pressure. Generally, as the dispersing temperature becomes higher, the dispersing becomes easier.

The amount of the aqueous medium used in emulsifying or dispersing the toner constituents is not particularly limited and may be appropriately selected according to the purpose, but is preferably in the range of from 50 to 2,000 parts by mass, more preferably from 100 to 1,000 parts by mass, based on 100 parts by mass of the toner constituents. When the used amount of the aqueous medium is less than 50 parts by mass, the dispersion state of the toner constituents may degrade and mother toner particles having a desired particle size cannot be obtained. When the used amount of the aqueous medium is in excess of 2,000 parts by mass, manufacturing cost may be increased.

Preferably, when the oil phase containing the toner constituents is emulsified or dispersed in the aqueous medium, a dispersant is used to stabilize dispersoids (oil droplets) to obtain toner particles with a desired shape and a narrow particle size distribution.

The dispersant is not particularly limited and may be appropriately selected depending on the purpose. Specific examples of the dispersant include, but are not limited to, surfactants, poorly-water-soluble inorganic compounds, and polymeric protection colloids. Each of these materials can be used alone or in combination with others. Among these, surfactants are preferable.

The surfactants are not particularly limited and may be appropriately selected according to the purpose. Examples of the surfactants include, but are not limited to, anionic surfactants, cationic surfactants, nonionic surfactants, and ampholytic surfactants. Specific examples of the anionic surfactants include, but are not limited to, alkylbenzene sulfonate, α-olefin sulfonate, and phosphate. Among these surfactants, those having a fluoroalkyl group are preferred.

Removal of Organic Solvent

A method for removing the organic solvent from the dispersion liquid such as an emulsion slurry is not particularly limited and may be appropriately selected depending on the purpose. For example, the method may include gradually raising the temperature of the reaction system to completely evaporate the organic solvent from oil droplets, or spraying the dispersion liquid into dry atmosphere to completely evaporate the organic solvent from oil droplets.

As the organic solvent has been removed, mother toner particles are formed. The mother toner particles are washed and dried, and optionally classified by size. The classification may be performed in a liquid by removing ultrafine particles by cyclone separation, decantation, or centrifugal separation. Alternatively, the classification may be performed after the mother toner particles have been dried.

The mother toner particles may be further mixed with particles of the external additive, the charge control agent, or the like. By applying a mechanical impact in the mixing, the particles of the external additive, etc., are suppressed from releasing from the surface of the mother toner particles.

A method for applying the mechanical impact is not particularly limited and may be appropriately selected depending on the purpose. For example, the method may include applying a mechanical impulsive force to the mixture using blades rotating at a high speed, or accelerating the mixture in a high-speed airflow to allow the particles collide with each other or a collision plate.

An apparatus used for the above method is not particularly limited and may be appropriately selected depending on the purpose. Examples of usable apparatuses include, but are not limited to, ONG MILL (available from Hosokawa Micron Co., Ltd.), 1-TYPE MILL (available from Nippon Pneumatic Mfg. Co., Ltd.) modified to reduce the pulverizing air pressure, HYBRIDIZATION SYSTEM (from Nara Machine Co., Ltd.), KRYPTON SYSTEM (from Kawasaki Heavy Industries, Ltd.), and an automatic mortar.

Electrostatic Latent Image Bearer

The electrostatic latent image bearer is not limited in material, structure, and size. Specific examples of usable materials include, but are not limited to, inorganic photoconductors such as amorphous silicon and selenium, and organic photoconductors such as polysilane and phthalopolymethine. Among these materials, amorphous silicon is preferable for long operating life.

The linear velocity of the electrostatic latent image bearer is preferably 300 mm/s or higher.

Electrostatic Latent Image Forming Device and Electrostatic Latent Image Forming Process The electrostatic latent image forming device is not particularly limited and can be appropriately selected according to the purpose as long as it is capable of forming an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

The electrostatic latent image forming process is not particularly limited and can be appropriately selected according to the purpose as long as an electrostatic latent image is formed on the electrostatic latent image bearer. For example, the electrostatic latent image forming process may include charging a surface of the electrostatic latent image bearer and irradiating the charged surface with light containing image information. The electrostatic latent image forming process can be performed by the electrostatic latent image forming device.

Charger and Charging Process

The charger is not particularly limited and may be appropriately selected according to the purpose. Specific examples of the charger include, but are not limited to, contact chargers equipped with a conductive or semiconductive roller, a brush, a film, or a rubber blade, and non-contact chargers employing corona discharge such as corotron and scorotron.

The charging process may include applying a voltage to a surface of the electrostatic latent image bearer by the charger.

The shape of the charger is determined in accordance with the specification or configuration of the image forming apparatus, and may be in the form of a roller, a magnetic brush, a fur brush, etc.

The charger is not limited to the contact charger. However, the contact charger is preferable because the amount of by-product ozone is small.

Irradiator and Irradiation Process

The irradiator is not particularly limited and may be appropriately selected depending on the purpose as long as it is capable of emitting light containing image information to the surface of the electrostatic latent image bearer charged by the charger. Specific examples of the irradiator include, but are not limited to, various irradiators of radiation optical system type, rod lens array type, laser optical type, and liquid crystal shutter optical type.

The light source used for the irradiator is not particularly limited and may be appropriately selected depending on the purpose. Specific examples thereof include, but are not limited to, luminescent matters such as fluorescent lamp, tungsten lamp, halogen lamp, mercury lamp, sodium lamp, light emitting diode (LED), laser diode (LD), and electroluminescence (EL).

For the purpose of emitting light having a desired wavelength only, any type of filter can be used, such as sharp cut filter, band pass filter, near infrared cut filter, dichroic filter, interference filter, and color-temperature conversion filter.

The irradiation process may include irradiating the surface of the electrostatic latent image bearer with light containing image information emitted from the irradiator.

The irradiation can also be conducted by irradiating the back surface of the electrostatic latent image bearer with light containing image information.

Developing Device and Developing Process

The developing device is not particularly limited and can be appropriately selected depending on the purpose so long as it stores the toner and develops the electrostatic latent image formed on the electrostatic latent image bearer with the toner to form a toner image (visible image).

The developing process is not particularly limited and can be appropriately selected depending on the purpose so long as the electrostatic latent image formed on the electrostatic latent image bearer is developed with the toner to form a toner image (visible image). The developing process may be performed by the developing device.

Preferably, the developing device includes a stirrer to frictionally stir and charge the toner, a magnetic field generator fixed inside the developing device, and a rotatable developer bearer to bear a developer containing the toner on its surface.

Transfer Device and Transfer Process

The transfer device is not particularly limited and can be appropriately selected depending on the purpose so long as it transfers the visible image onto a recording medium. Preferably, the transfer device includes a primary transfer device to transfer the visible image onto an intermediate transfer medium to form a composite transfer image, and a secondary transfer device to transfer the composite transfer image onto a recording medium.

The transfer process is not particularly limited and can be appropriately selected depending on the purpose so long as the visible image is transferred onto a recording medium. Preferably, the transfer process includes primarily transferring the visible image onto an intermediate transfer medium and secondarily transferring the visible image onto a recording medium.

In the transfer process, the visible image may be transferred by charging the electrostatic latent image bearer by a transfer charger. The transfer process can be performed by the transfer device.

When the image to be secondarily transferred onto the recording medium is a color image formed of multiple toners having different colors, each color toner is sequentially superimposed on one another on the intermediate transfer medium to form a composite image thereon and then the composite image on the intermediate transfer medium is secondarily transferred onto the recording medium.

The intermediate transfer medium is not particularly limited and can be appropriately selected from among known transfer members according to the purpose. Specific preferred examples of the intermediate transfer medium include, but are not limited to, a transfer belt.

The transfer device (including the primary transfer device and the secondary transfer device) preferably includes a transferrer configured to separate the visible image formed on the electrostatic latent image bearer to the recording medium side by charging. Specific examples of the transferrer include, but are not limited to, a corona transferrer utilizing corona discharge, a transfer belt, a transfer roller, a pressure transfer roller, and an adhesive transferrer.

Although the recording medium is typically plain paper, it is not particularly limited and can be appropriately selected according to the purpose as long as it is capable of transferring an unfixed image developed. For example, a PET (polyethylene terephthalate) base for use in overhead projector (OHP) can be used as the recording medium.

Other Devices and Other Processes

The other devices to be optionally included may be, for example, a cleaner, a neutralizer, a recycler, and/or a controller.

The other processes to be optionally included may be, for example, a cleaning process, a neutralization process, a recycle process, and a control process.

Cleaner and Cleaning Process

The cleaner is not particularly limited and can be appropriately selected according to the purpose as long as it is capable of removing residual toner particles remaining on the electrostatic latent image bearer. Specific examples of the cleaner include, but are not limited to, a magnetic brush cleaner, an electrostatic brush cleaner, a magnetic roller cleaner, a blade cleaner, a brush cleaner, and a web cleaner.

The cleaning process is not particularly limited and can be appropriately selected according to the purpose as long as residual toner particles remaining on the electrostatic latent image bearer are removed. The cleaning process can be performed by the cleaner.

Neutralizer and Neutralization Process

The neutralizer is not particularly limited and can be appropriately selected according to the purpose as long as it is capable of eliminate charge on the electrostatic latent image bearer by application of a neutralization bias thereto. Specific examples of the neutralizer include, but are not limited to, a neutralization lamp.

The neutralization process is not particularly limited and can be appropriately selected according to the purpose as long as the electrostatic latent image bearer is neutralized by application of a neutralization bias thereto. The neutralization process can be performed by the neutralizer.

Recycler and Recycle Process

The recycler is not particularly limited and can be appropriately selected according to the purpose as long as it is capable of making the developing device recycle the toner removed in the cleaning process. Specific examples of the recycler include, but are not limited to, a conveyer.

The recycle process is not particularly limited and can be appropriately selected according to the purpose as long as the toner particles removed in the cleaning process are recycled by the developing device. The recycle process can be performed by the recycler.

Figure 5:
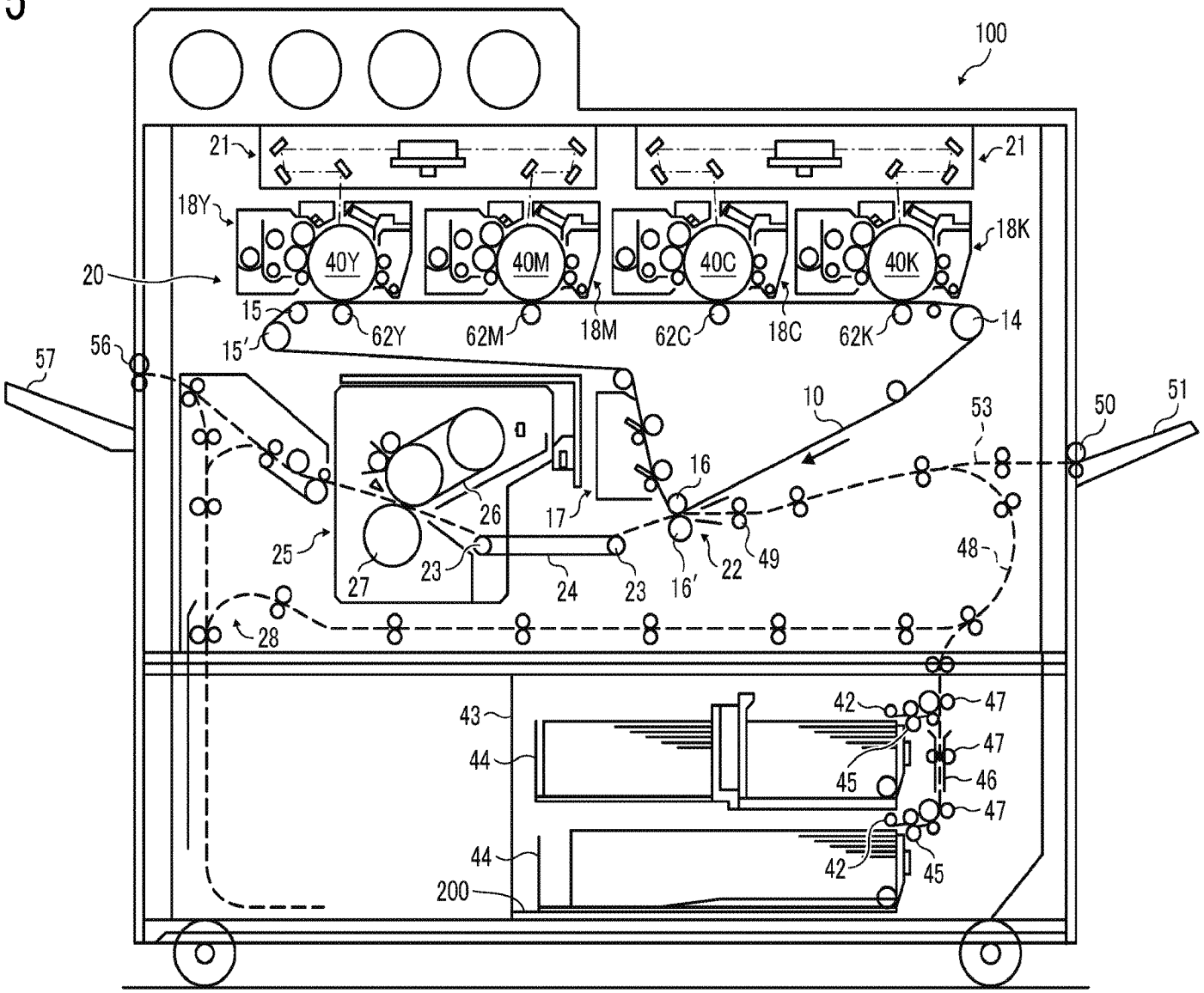
FIG. 5 is a schematic view of an image forming apparatus according to an embodiment of the present invention.

FIG. 5 is a schematic view of an image forming apparatus according to an embodiment of the present invention.

The image forming apparatus illustrated in FIG. 5 includes an image forming apparatus main body 100 (hereinafter simply "main body 100") employing a tandem intermediate transfer system and a sheet feeding table 200 on which the main body 100 is placed.

In the main body 100, multiple image forming units 18Y, 18M, 18C, and 18K are disposed side by side, forming a tandem image forming unit 20 employing a tandem intermediate transfer system. The suffixes Y, M, C, and K attached to the reference numerals represent yellow, magenta, cyan, and black, respectively.

At the center of the main body 100, an intermediate transfer belt 10, as an intermediate transfer medium in the form of an endless belt, is disposed. The intermediate transfer belt 10 is wound around a plurality of support rollers 14, 15, 15', and 16 and is rotatable clockwise in FIG. 5. A cleaner 17 for cleaning the intermediate transfer belt 10 is disposed on the left side of the support roller 16. The cleaner 17 removes residual toner particles remaining on the intermediate transfer belt 10 after image transfer.

Above the intermediate transfer belt 10 stretched between the support roller 14 and the support roller 15, the four image forming units 18Y, 18M, 18C, and 18K for yellow (Y), magenta (M), cyan (C), and black (K), respectively, are arranged side by side along the direction of conveyance of the intermediate transfer belt 10, forming the tandem image forming unit 20. The image forming units 18Y, 18M, 18C, and 18K of the tandem image forming unit 20 have respective photoconductor drums 40Y, 40M, 40C, and 40K serving as electrostatic latent image bearers for carrying toner images of respective colors of yellow, magenta, cyan, and black.

Above the tandem image forming unit 20, two irradiators 21 are disposed as illustrated in FIG. 5. One of the irradiators 21 corresponds to the two image forming units 18Y and 18M and the other corresponds to the two image forming units 18C and 18K. Each of the irradiators 21 may be an optical scanning irradiator containing two light source devices (e.g., a semiconductor laser, a semiconductor laser array, a multibeam light source) and coupling optical systems, a common optical deflector (e.g., a polygon mirror), and two scanning imaging optical systems. The irradiators 21 irradiate the photoconductor drums 40Y, 40M, 40C, and 40K with light in accordance with image information of respective colors of yellow, magenta, cyan, and black to form electrostatic latent images.

Around each of the photoconductor drums 40Y, 40M, 40C, and 40K in the respective image forming units 18Y, 18M, 18C, and 18K, a charger for uniformly charging the photoconductor drum prior to the irradiation of light, a developing device for developing an electrostatic latent image formed by the irradiator 21 with each color toner, and a photoconductor cleaner for removing residual toner remaining on the photoconductor drum without being transferred are disposed.

At primary transfer positions where each toner image is transferred from the photoconductor drums 40Y, 40M, 40C, and 40K to the intermediate transfer belt 10, primary transfer rollers 62Y, 62M, 62C, and 62K, as components of a primary transfer device, are respectively disposed facing the respective photoconductor drums 40Y, 40M, 40C, and 40K with the intermediate transfer belt 10 sandwiched therebetween.

Of the plurality of support rollers supporting the intermediate transfer belt 10, the support roller 14 is a driving roller for rotationally driving the intermediate transfer belt 10 and is connected to a motor via a drive transmission mechanism (e.g., gear, pulley, belt). In the case of forming a monochrome image of black on the intermediate transfer belt 10, the support rollers 15 and 15', other than the support roller 14, are moved by a moving mechanism to separate the photoconductor drums 40Y, 40M, and 40C for yellow, magenta, cyan, respectively, from the intermediate transfer belt 10.

On the side opposite to the tandem image forming unit 20 with respect to the intermediate transfer belt 10, a secondary transfer device 22 is disposed. In the present embodiment, in the secondary transfer device 22, a secondary transfer roller 16' presses against the support roller 16 to apply a transfer electric field, whereby the toner image on the intermediate transfer belt 10 is transferred onto a transfer sheet serving as a recording medium.

On one side of the secondary transfer device 22, the fixing device 25 that fixes a transferred image on the transfer sheet is disposed. The fixing device 25 includes the fixing belt 26 in the form of an endless belt and the pressure roller 27 pressed against the fixing belt 26. The fixing belt 26 is stretched between two support rollers. At least one of the support roller is equipped with a heating device (e.g., heater, lamp, electromagnetic heater).

The transfer sheet onto which the image has been transferred by the secondary transfer device 22 is conveyed to the fixing device 25 by a conveyance belt 24 supported by two rollers 23. The conveyance belt 24 may be replaced with a fixed guide member or a conveyance roller.

In the present embodiment, below the secondary transfer device 22 and the fixing device 25 and in parallel with the tandem image forming unit 20, a sheet reversing device 28 is disposed that reverses and conveys a transfer sheet so that images can be recorded on both sides of the transfer sheet.

Conveyance of the sheet is performed as follows. First, one of sheet feeding rollers 42 in the sheet feeding table 200 starts rotating to feed a sheet of from one of sheet feeding trays 44 in a sheet bank 43. The sheets thus fed are separated one by one by a separation roller 45, guided to a feeding path 46, conveyed by conveyance roller pairs 47, and guided to a feeding path 48 in the main body 100, and brought into contact with an alignment roller (registration roller) pair 49 to stop.

Alternatively, in the case of using a manual sheet feeding tray 51, a feed roller 50 is rotated to feed sheets stacked on the manual sheet feeding tray 51. The sheet thus fed are separated one by one, guided to a manual feeding path 53, and brought into contact with the alignment roller pair 49 to stop.

The alignment roller pair 49 is then rotated in synchronization with formation of a full-color toner image on the intermediate transfer belt 10 to feed the sheet to a secondary transfer position formed between the intermediate transfer belt 10 and the secondary transfer roller 16'. The full-color toner image on the intermediate transfer belt 10 is then transferred onto the sheet at once.

The sheet onto which the toner image has been transferred is conveyed to the fixing device 25 by the conveyance belt 24. In the fixing device 25, the toner image is fixed on the sheet by application of heat and pressure. The sheet having the fixed toner image thereon is ejected by an ejection roller 56 to be stacked on a sheet ejection tray 57.

In the case of duplex copying, the sheet on which the image has been fixed on one side is guided to the sheet reversing device 28 and gets reversed. The sheet is then guided again to the secondary transfer position so that another image is transferred to the back side. After the image is fixed on the sheet in the fixing device 25, the sheet is ejected by the ejection roller 56 onto the sheet ejection tray 57.

Developer

A developer according to an embodiment of the present invention comprises at least the above-described toner and optionally other components such as a carrier. The developer has excellent transferability and chargeability is capable of reliably forming high-quality image. The developer may be either one-component developer or two-component developer. To be used for high-speed printers corresponding to recent improvement in information processing speed, two-component developer is preferable, because the lifespan of the printer can be extended.

In the case of one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

Carrier

The carrier is not particularly limited and may be appropriately selected according to the purpose, but the carrier preferably comprises a core material and a resin layer that covers the core material.

Core Material

The core material is not particularly limited and may be appropriately selected depending on the purpose. Specific examples of the core material include, but are not limited to, manganese-strontium materials having a magnetization of from 50 to 90 emu/g and manganese-magnesium materials having a magnetization of from 50 to 90 emu/g. For securing image density, high magnetization materials, such as iron powders having a magnetization of 100 emu/g or more and magnetites having a magnetization of from 75 to 120 emu/g, are preferable. Additionally, low magnetization materials, such as copper-zinc materials having a magnetization of from 30 to 80 emu/g, are preferable for improving image quality, because such materials are capable of reducing the impact of the magnetic brush to a photoconductor.

Each of these materials can be used alone or in combination with others.

The volume average particle diameter of the core material is not particularly limited and may be appropriately selected according to the purpose, but is preferably in the range of from 10 to 150 μm, more preferably from 40 to 100 μm.

The toner of the present embodiment can be mixed with the carrier to prepare a developer.

The content of the carrier in the two-component developer is not particularly limited and may be appropriately selected according to the purpose, but is preferably from 90 to 98 parts by mass, more preferably from 93 to 97 parts by mass, based on 100 parts by mass of the two-component developer.

The developer can be used for various electrophotographic image forming methods such as magnetic one-component developing method, non-magnetic one-component developing method, and two-component developing method.

Developer Storage Container

The developer storage container for storing the developer of the present embodiment is not particular limited and can be appropriately selected from known ones. For example, the developer storage container may include a container body and a cap.

The container body is not limited in size, shape, structure, and material. Preferably, the container body has a cylindrical shape. Preferably, on the inner circumferential surface of the container body, projections and recesses are formed in a spiral manner, so that the developer can move to the discharge port side as the container body rotates. More preferably, part or all of the projections and recesses formed in a spiral manner have an accordion function. Further, the container body is preferably made of a material having good dimension accuracy. Examples of such a material include, but are not limited to, resin materials such as polyester resin, polyethylene resin, polypropylene resin, polystyrene resin, polyvinyl chloride resin, polyacrylic acid, polycarbonate resin, ABS resin, and polyacetal resin.

The developer storage container is easy to preserve, transport, and handle. Therefore, the developer storage container is detachably mountable on a process cartridge or an image forming apparatus to supply the developer thereto.

EXAMPLES

The embodiments of the present invention are further described in detail with reference to the Examples but is not limited to the following Examples. In the following descriptions, "parts" represents parts by mass and "% (percent)" represents percent by mass unless otherwise specified.

Production Example A-1

Synthesis of Prepolymer A-1 (Amorphous Polyester Resin A-1)

A reaction vessel equipped with a cooling tube, a stirrer, and a nitrogen introducing tube was charged with diol components comprising 100% by mol of 3-methyl-1,5-pentanediol, dicarboxylic acid components comprising 40% by mol of isophthalic acid and 60% by mol of adipic acid, and 1% by mol (based on all monomers) of trimellitic anhydride, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-1 was prepared.

Next, a reaction vessel equipped with a cooling tube, a stirrer, and a nitrogen introducing tube was charged with the intermediate polyester A-1 and isophorone diisocyanate (IPDI) such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer A-1 was prepared.

In Examples and Comparative Examples described below, the prepolymer A-1 is converted to a polyester resin component A-1, corresponding to the polyester resin component A, in the process of preparing a toner. (This applies to each of Production Examples A and B).

Production Example A-2

Synthesis of Prepolymer A-2 (Amorphous Polyester Resin A-2)

A reaction vessel equipped with a cooling tube, a stirrer, and a nitrogen introducing tube was charged with diol components comprising 100% by mol of 3-methyl-1,5-pentanediol, dicarboxylic acid components comprising 33% by mol of isophthalic acid and 67% by mol of adipic acid, and 1% by mol (based on all monomers) of trimellitic anhydride, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-2 was prepared.

Next, a reaction vessel equipped with a cooling tube, a stirrer, and a nitrogen introducing tube was charged with the intermediate polyester A-2 and isophorone diisocyanate (IPDI) such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer A-2 was prepared.

Production Example A-3

Synthesis of Prepolymer A-3 (Amorphous Polyester Resin A-3)

A reaction vessel equipped with a cooling tube, a stirrer, and a nitrogen introducing tube was charged with diol components comprising 100% by mol of 3-methyl-1,5-pentanediol, dicarboxylic acid components comprising 67% by mol of isophthalic acid and 33% by mol of adipic acid, and 1% by mol (based on all monomers) of trimellitic anhydride, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-3 was prepared.

Next, a reaction vessel equipped with a cooling tube, a stirrer, and a nitrogen introducing tube was charged with the intermediate polyester A-3 and isophorone diisocyanate (IPDI) such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer A-3 was prepared.

Production Example B-1

Synthesis of Prepolymer B-1 (Amorphous Polyester Resin B-1)

A reaction vessel equipped with a cooling tube, a stirrer, and a nitrogen introducing tube was charged with diol components comprising 80% by mol of ethylene oxide 2 mol adduct of bisphenol A and 20% by mol of propylene oxide 2 mol adduct of bisphenol A and dicarboxylic acid components comprising 60% by mol of terephthalic acid and 40% by mol of adipic acid, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further allowed to react under reduced pressures of from 10 to 15 mmHg for 5 hours. Thus, an intermediate polyester B-1 was prepared.

Next, a reaction vessel equipped with a cooling tube, a stirrer, and a nitrogen introducing tube was charged with the intermediate polyester B-1 and isophorone diisocyanate (IPDI) such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer B-1 was prepared.

Production Example C-1

Synthesis of Amorphous Polyester Resin C-1

A four-neck flask equipped with a nitrogen inlet tube, a dewatering tube, a stirrer, and a thermocouple was charged with ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 75/25, and trimethylolpropane (TMP) in an amount of 1% by mol (based on all the monomers), such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-1 was prepared.

Production Example C-2

Synthesis of Amorphous Polyester Resin C-2

A four-neck flask equipped with a nitrogen inlet tube, a dewatering tube, a stirrer, and a thermocouple was charged with ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 65/35, and trimethylolpropane (TMP) in an amount of 1% by mol (based on all the monomers), such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-2 was prepared.

Production Example C-3

Synthesis of Amorphous Polyester Resin C-3

A four-neck flask equipped with a nitrogen inlet tube, a dewatering tube, a stirrer, and a thermocouple was charged with ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 85/15, and trimethylolpropane (TMP) in an amount of 1% by mol (based on all the monomers), such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-3 was prepared.

Production Example D-1

Synthesis of Crystalline Polyester Resin D-1

A 5-L four-neck flask equipped with a nitrogen inlet tube, a dewatering tube, a stirrer, and a thermocouple was charged with dodecanedioic acid and 1,6-hexanediol such that the molar ratio (OH/COOH) of hydroxyl groups to carboxyl groups became 0.9. After adding 500 ppm (based on the resin components) of titanium tetraisopropoxide to the flask, the flask contents were allowed to react at 180° C. for 10 hours, thereafter at 200° C. for 3 hours, and further under a pressure of 8.3 kPa for 2 hours. Thus, a crystalline polyester resin D-1 was prepared.

Preparation of Crystalline Polyester Resin Dispersion Liquid

In a vessel equipped with a stirrer and a thermometer, 50 parts of the crystalline polyester resin D-1 and 450 parts of ethyl acetate were heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid 1 was prepared.

Production Example E-1

Preparation of Toner 1

Preparation of Master Batch

First, 1,200 parts of water, 500 parts of a carbon black (PRINTEX 35 manufactured by Degussa, having a DBP oil absorption of 42 mL/100 mg and a pH of 9.5), and 500 parts of the amorphous polyester resin C-1 were mixed with a HENSCHEL MIXER (manufactured by Mitsui Mining and Smelting Co., Ltd.). The mixture was kneaded with a double roll at 150° C. for 30 minutes, thereafter rolled to cool, and pulverized with a pulverizer. Thus, a master batch 1 was prepared.

Preparation of Wax Dispersion Liquid

In a vessel equipped with a stirrer and a thermometer, 50 parts of a paraffin wax (HNP-9 available from NIPPON SEIRO CO., LTD., a hydrocarbon wax having a melting point of 75° C. and a solubility parameter (SP) of 8.8), serving as a release agent 1, and 450 parts of ethyl acetate were heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes). Thus, a wax dispersion liquid 1 was prepared.

Synthesis of Ketimine Compound

In a reaction vessel equipped with a stirrer and a thermometer, 170 parts of isophoronediamine and 75 parts of methyl ethyl ketone were allowed to react at 50° C. for 5 hours. Thus, a ketimine compound 1 was prepared.

The ketimine compound 1 had an amine value of 418.

Preparation of Oil Phase

In a vessel, 500 parts of the wax dispersion liquid 1, 76 parts of the prepolymer A-1, 152 parts of the prepolymer B-1, 803 parts of the amorphous polyester resin C-1, 334 parts of the crystalline polyester resin dispersion liquid 1, 100 parts of the master batch 1, and 2 parts of the ketimine compound 1 as a curing agent were mixed with a TK HOMOMIXER (available from PRIMIX Corporation) at a revolution of 5,000 rpm for 60 minutes. Thus, an oil phase 1 was prepared.

Preparation of Organic Fine Particle Emulsion (Fine Particle Dispersion Liquid)

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were stirred at a revolution of 400 rpm for 15 minutes. Thus, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid 1 was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid 1 had a volume average particle diameter of 0.14 μm when measured by an instrument LA-920 (available from HORIBA, Ltd.).

A part of the fine particle dispersion liquid 1 was dried to isolate the resin.

Preparation of Aqueous Phase

An aqueous phase 1 was prepared by stir-mixing 990 parts of water, 83 parts of the fine particle dispersion liquid 1, 37 parts of a 48.5% aqueous solution of sodium dodecyl diphenyl ether disulfonate (ELEMINOL MON-7 available from Sanyo Chemical Industries, Ltd.), and 90 parts of ethyl acetate. The aqueous phase 1 was a milky white liquid.

Emulsification and Solvent Removal

In the vessel containing the oil phase 1, 1,200 parts of the aqueous phase 1 was mixed with the oil phase 1 by a TK HOMOMIXER at a revolution of 13,000 rpm for 20 minutes. Thus, an emulsion slurry 1 was prepared. The emulsion slurry 1 was put in a vessel equipped with a stirrer and a thermometer and subjected to solvent removal at 30° C. for 8 hours and subsequently to aging at 45° C. for 4 hours. Thus, a dispersion slurry 1 was obtained.

Washing and Drying

After 100 parts of the dispersion slurry 1 was filtered under reduced pressures, the following operations were carried out.

(1) The filter cake was mixed with 100 parts of ion-exchange water using a TK HOMOMIXER at a revolution of 12,000 rpm for 10 minutes and thereafter filtered.

(2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures.

(3) 100 parts of a 10% aqueous solution of hydrochloric acid was added to the filter cake of (2) and mixed therewith using a TK HOMOMIXER at a revolution of 12,000 rpm for 10 minutes, followed by filtration.

(4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake.

The filter cake was dried by a circulating air dryer at 45° C. for 48 hours and then filtered with a mesh having an opening of 75 μm. Thus, a mother toner particle 1 was prepared.

External Addition Treatment

Next, 100 parts of the mother toner particle 1 was mixed with 0.6 parts by mass of a hydrophobic silica having an average particle diameter of 100 nm, 1.0 part by mass of a titanium oxide having an average particle diameter of 20 nm, and 0.8 parts by mass of a hydrophobic silica powder having an average particle diameter of 15 nm using a HENSCHEL MIXER. Thus, a toner 1 was obtained.

Production Example E-2

Preparation of Toner 2

The procedure in Production Example E-1 was repeated except for changing the amount of the amorphous polyester resin C-1 to 769 parts and the amount of the crystalline polyester resin dispersion liquid 1 to 669 parts in the process of "Preparation of Oil Phase". Thus, a toner 2 was prepared.

Production Example E-3

Preparation of Toner 3

The procedure in Production Example E-1 was repeated except for changing the amount of the amorphous polyester resin C-1 to 819 parts and the amount of the crystalline polyester resin dispersion liquid 1 to 167 parts in the process of "Preparation of Oil Phase". Thus, a toner 3 was prepared.

Production Example E-4

Preparation of Toner 4

The procedure in Production Example E-1 was repeated except for replacing the prepolymer A-1 with the prepolymer A-2 in the process of "Preparation of Oil Phase". Thus, a toner 4 was prepared.

Production Example E-5

Preparation of Toner 5

The procedure in Production Example E-1 was repeated except for replacing the prepolymer A-1 with the prepolymer A-3 in the process of "Preparation of Oil Phase". Thus, a toner 5 was prepared.

Production Example E-6

Preparation of Toner 6

The procedure in Production Example E-1 was repeated except for replacing the amorphous polyester resin C-1 with the amorphous polyester resin C-2 in the process of "Preparation of Oil Phase". Thus, a toner 6 was prepared.

Production Example E-7

Preparation of Toner 7

The procedure in Production Example E-1 was repeated except for replacing the amorphous polyester resin C-1 with the amorphous polyester resin C-3 in the process of "Preparation of Oil Phase". Thus, a toner 7 was prepared.

Production Example E-8

Preparation of Toner 8

The procedure in Production Example E-1 was repeated except for changing the amount of the amorphous polyester resin C-1 to 828 parts and the amount of the crystalline polyester resin dispersion liquid 1 to 84 parts in the process of "Preparation of Oil Phase". Thus, a toner 8 was prepared.

Production Example E-9

Preparation of Toner 9

The procedure in Production Example E-1 was repeated except for changing the amount of the amorphous polyester resin C-1 to 761 parts and the amount of the crystalline polyester resin dispersion liquid 1 to 752 parts in the process of "Preparation of Oil Phase". Thus, a toner 9 was prepared.

Production Example E-10

Preparation of Toner 10

The procedure in Production Example E-1 was repeated except for replacing the prepolymer A-1 and the amorphous polyester resin C-1 with the prepolymer A-2 the amorphous polyester resin C-2, respectively, in the process of "Preparation of Oil Phase". Thus, a toner 10 was prepared.

Production Example E-11

Preparation of Toner 11

The procedure in Production Example E-1 was repeated except for replacing the prepolymer A-1 and the amorphous polyester resin C-1 with the prepolymer A-3 the amorphous polyester resin C-3, respectively, in the process of "Preparation of Oil Phase". Thus, a toner 11 was prepared.

Measurement for Toner

The toners 1 to 11 prepared in Production Examples E-1 to E-11 were subjected to the following measurements. The results are presented in Table 1.

Measurement of Tg1st of Toner and Glass Transition Temperatures of Polyester Resin Components A, B, and C First, 1 g of the toner was put in 100 mL of THF and subjected to Soxhlet extraction to obtain THF-soluble matter and THF-insoluble matter. The THF-soluble matter and the THF-insoluble matter were dried in a vacuum dryer for 24 hours, thus obtaining a mixture of the polyester resin component C and the crystalline polyester resin D from the THF soluble matter and a mixture of the polyester resin component A and the polyester resin component B from the THF-insoluble matter. The mixtures thus obtained were treated as target samples. Also, the toner was treated as a target sample for measuring Tg1st of the toner.

Next, about 5.0 mg of each target sample was put in an aluminum sample container. The sample container was put on a holder unit and set in an electric furnace. The temperature was raised from −80° C. to 150° C. at a temperature rising rate of 10° C./min ("first heating") in nitrogen atmosphere. The temperature was thereafter lowered from 150° C. to −80° C. at a temperature falling rate of 10° C./min and raised to 150° C. again at a temperature rising rate of 10° C./min ("second heating"). In each of the first heating and the second heating, a DSC curve was obtained by a differential scanning calorimeter (Q-200 available from TA Instruments).

The obtained DSC curves were analyzed with analysis program installed in Q-200. By selecting the DSC curve obtained in the first heating, a glass transition temperature Tg1st of the target sample in the first heating was determined. Similarly, by selecting the DSC curve obtained in the second heating, a glass transition temperature Tg2nd of the target sample in the second heating was determined.

Measurement of Storage Elastic Modulus G'

Storage modulus G' under various conditions were measured by a rheometer (ARES manufactured by TA Instruments). Specifically, a measurement sample was molded into a pellet having a diameter of 8 mm and a thickness of 1 to 2 mm. The pellet was set between parallel plates having a diameter of 8 mm and stabilized at 40° C. The temperature was then raised to 100° C. at a temperature rising rate of 2.0° C./min under a frequency of 1 Hz (6.28 rad/s) and a strain amount of 0.1% (strain amount control mode), and a storage elastic modulus of the sample was measured at 70° C. in the process of temperature rising. The temperature was then lowered to 30° C. at a temperature falling rate of 10.0° C./min under a frequency of 1 Hz (6.28 rad/s) and a strain amount of 1.0% (strain amount control mode), and a storage elastic modulus of the sample was measured at 70° C. in the process of temperature falling.

Production Example F-1

Preparation of Refresh Roller (Fixing Surface Reformer) 1

Preparation of Coating Material

The following constituent materials were stirred and dispersed to obtain a coating material.

Constituent Materials

- DOW CORNING TORAY DY35-7002A CLEAR (main ingredient, manufactured by Dow Corning Toray Co., Ltd.)
- DOW CORNING TORAY DY35-7002B CLEAR (curing agent, manufactured by Dow Corning Toray Co., Ltd.)
- White alumina (abrasive grains, having an average grain size of 4.5 μm)
- Toluol Application of Coating Material A surface of a cylindrical core of a refresh roller was coated with the coating material by a coating gun.

The coating material was mixed with the air in the coating gun and jetted to the core by the atomization pressure by the air.

By controlling coating conditions, the surface roughness of the resulting coating film can be adjusted such that the ten-point average roughness is in the range of from 50 to 90 μm and the peak-to-valley average distance is in the range of from 90 to 140 μm.

After completion of jetting of the coating material, the core on which the coating film was formed was taken out and subjected to vulcanization. After a lapse of a predetermined vulcanization time, the core having the coating film was cooled in a room temperature environment. Thus, a refresh roller 1 was prepared.

Production Example F-2

Preparation of Refresh Roller (Fixing Surface Reformer) 2

The procedure in Production Example F-1 was repeated except for changing the average grain size of the abrasive grains (white alumina) to 2.6 μm. Thus, a refresh roller 2 was prepared.

Production Example F-3

Preparation of Refresh Roller (Fixing Surface Reformer) 3

The procedure in Production Example F-1 was repeated except for changing the average grain size of the abrasive grains (white alumina) to 5.9 μm. Thus, a refresh roller 3 was prepared.

Production Example F-4

Preparation of Refresh Roller (Fixing Surface Reformer) 4

The procedure in Production Example F-1 was repeated except for changing the average grain size of the abrasive grains (white alumina) to 1.8 μm. Thus, a refresh roller 4 was prepared.

Production Example F-5

Preparation of Refresh Roller (Fixing Surface Reformer) 5

The procedure in Production Example F-1 was repeated except for changing the average grain size of the abrasive grains (white alumina) to 7.3 μm. Thus, a refresh roller 5 was prepared.

Production Example G-1

Preparation of Carrier

A resin layer coating liquid was prepared by dispersing 100 parts by mass of a silicone resin (organo straight silicone), 5 parts by mass of γ-(2-aminoethyl) aminopropyl trimethoxysilane, and 10 parts by mass of a carbon black in 100 parts by mass of toluene by a homomixer for 20 minutes. The resin layer coating liquid was applied to the surfaces of 1,000 parts of spherical magnetite having an average particle diameter of 50 μm by a fluidized bed coating device. Thus, a carrier was prepared.

Example 1

Preparation of Developer

A developer was prepared by mixing 5 parts by mass of the toner 1 prepared in Production Example E-1 and 95 parts by mass of the carrier prepared in Production Example G-1 using a ball mill.

Evaluations

The following evaluation was made with the developer containing the toner 1 and the refresh roller 1. The results are presented in Table 3.

Evaluation of Low-Temperature Fixability on Plain Paper

The developer was set in the image forming apparatus illustrated in FIG. 5, and a solid image having a rectangular shape of 2 cm×15 cm and a toner deposition amount of 0.40 mg/cm$^2$ was formed on sheets of PPC paper TYPE 6000 <70W> A4 Machine Direction (manufactured by Ricoh Co., Ltd.) by monochrome mode. The surface temperature of the fixing roller was changed and whether an offset occurred or not was observed at each temperature. Here, the offset is a phenomenon in which a residual image of the solid image is fixed at a position other than the desired position. The lowest fixing temperature at which the offset did not occur ("lower-limit fixable temperature") was determined to evaluate cold offset property. The solid image was formed on a position on the sheet 3.0 cm away from the leading edge in the sheet feeding direction. The velocity of the sheet passing through the nip portion of the fixing device was 300 mm/s.

Evaluation Criteria for Cold Offset Property

A: The lower-limit fixable temperature is 130° C. or lower.

B: The lower-limit fixable temperature is higher than 130° C. and at most 135° C.

C: The lower-limit fixable temperature is higher than 135° C. and at most 140° C.

D: The lower-limit fixable temperature is higher than 140° C.

Evaluation of Blocking Property

A solid image having a rectangular shape of 3 cm×15 cm and a toner deposition amount of 0.85 mg/cm$^2$ was continuously formed on one side of each of 200 sheets of PPC paper TYPE 6000 <70W> A4 Machine Direction (manufactured by Ricoh Co., Ltd.). The fixing temperature was controlled at around the temperature 20 degrees higher than the temperature at which cold offset temperature occurred. The 200 sheets having the image thereon were stacked and allowed to stand for 1 hour, after which the degree of sticking of the images was evaluated.

Evaluation Criteria for Blocking Property

A: The sheets are not sticking to each other.

B: The sheets are slightly sticking to each other but easily peel from each other. No problem in the separated images.

C: The sheets are slightly sticking to each other. Some noise is made when the sheets separates from each other. There is no problem in image quality.

D: The sheets are sticking to each other. The images and the sheets are damaged when the sheets separate from each other.

Evaluation of Image Streaks

The developer was set in the image forming apparatus illustrated in FIG. 5, and a solid image having a rectangular shape of 2 cm×15 cm and a toner deposition amount of 0.80 mg/cm$^2$ was formed on sheets of PPC paper TYPE 6000 <70W> A4 Machine Direction (manufactured by Ricoh Co., Ltd.) by monochrome mode. The fixing temperature was controlled at around the temperature 20 degrees C. higher than the temperature at which cold offset temperature occurred. The evaluation of image streaks was conducted for the images output on 200 sheets.

Evaluation Criteria

A: No image streak occurs.

B: Image streaks occur partially, but there is no problem in image quality.

C: Image streaks occur on the entire surface, but there is no problem in image quality.

D: Image streaks occur on the entire surface, and there is a problem in image quality.

Evaluation of Image Gloss

A copy test was performed by a copier MF2200 (manufactured by Ricoh Co., Ltd.) employing a TEFLON (registered trademark) roller as the fixing roller, the fixing of which had been modified, using a paper TYPE 6200 (manufactured by Ricoh Co., Ltd.). The fixing temperature was set to a temperature 20 degrees C. higher than the lower-limit fixable temperature that had been determined for evaluating low-temperature fixability. The sheet feed linear velocity was set to 120 to 150 mm/sec, the surface pressure was set to 1.2 kgf/cm$^2$, and the nip width was set to 3 mm. The fixed image was subjected to a measurement of 60-degree gloss value with a gloss meter VG-7000 (available from NIPPON DENSHOKU INDUSTRIES CO., LTD.). Image gloss was evaluated based on the following criteria.

Evaluation Criteria

A: 30% or higher and lower than 35%

B: 25% or higher and lower than 30%, or 35% or higher and lower than 40%

C: 20% or higher and lower than 25%, or 40% or higher and lower than 45%

D: lower than 20%, or 45% or higher

Examples 2 to 13 and Comparative Examples 1 to 6

The procedure in Example 1 is repeated except for changing the combination of the toner and the refresh roller according to the description in Table 3. The results are presented in Table 3.

The produced toners are summarized in Table 1.

TABLE 1

| Toner No. | Pre-polymer | Amorphous Polyester Resin C | Crystalline Polyester Resin D | Tg1st of Toner (° C.) | Tg1st of THF-insoluble Matter (° C.) | Tg2nd of THF-insoluble Matter (° C.) | Tg2nd of THF-soluble Matter (° C.) | G' in Temp. Rising (Pa) | G' in Temp. Falling (Pa) | Amount of Heat Absorption (J/g) |
|---|---|---|---|---|---|---|---|---|---|---|
| Toner 1 | A-1 | C-1 | D-1 | 57 | −35 | 10 | 41 | 5.6 × 10^6 | 6.8 × 10^7 | 4.1 |
| Toner 2 | A-1 | C-1 | D-1 | 56 | −36 | 10 | 35 | 7.8 × 10^5 | 1.2 × 10^7 | 8.2 |
| Toner 3 | A-1 | C-1 | D-1 | 57 | −36 | 11 | 47 | 9.3 × 10^6 | 9.7 × 10^7 | 2.5 |
| Toner 4 | A-2 | C-1 | D-1 | 55 | −45 | 3 | 39 | 2.3 × 10^6 | 2.2 × 10^7 | 4.2 |
| Toner 5 | A-3 | C-1 | D-1 | 60 | 6 | 28 | 43 | 9.4 × 10^6 | 8.1 × 10^7 | 4.1 |
| Toner 6 | A-1 | C-2 | D-1 | 52 | −36 | 10 | 34 | 5.5 × 10^5 | 1.3 × 10^7 | 4.2 |
| Toner 7 | A-1 | C-3 | D-1 | 63 | −35 | 10 | 48 | 8.9 × 10^6 | 1.4 × 10^8 | 4.2 |
| Toner 8 | A-1 | C-1 | D-1 | 57 | −35 | 9 | 50 | 6.4 × 10^7 | 4.4 × 10^8 | 1.5 |
| Toner 9 | A-1 | C-1 | D-1 | 56 | −34 | 10 | 32 | 3.1 × 10^5 | 3.2 × 10^6 | 8.9 |
| Toner 10 | A-2 | C-2 | D-1 | 50 | −45 | 3 | 34 | 1.1 × 10^5 | 5.2 × 10^6 | 3.9 |
| Toner 11 | A-3 | C-3 | D-1 | 64 | 5 | 32 | 55 | 8.2 × 10^7 | 3.4 × 10^8 | 4.2 |

In Tables 1 and 3, "^" represents a power of 10. For example, "10^7" represents "$10^7$".

The produced refresh rollers are summarized in Table 2.

TABLE 2

| Refresh Roller No. | Average Grain Size of Abrasive Grains (μm) | Ten-point Average Roughness | Peak-to-valley Average Distance |
|---|---|---|---|
| Roller 1 | 4.5 | 50 to 90 μm | 90 to 140 μm |
| Roller 2 | 2.6 | 50 to 90 μm | 90 to 140 μm |
| Roller 3 | 5.9 | 50 to 90 μm | 90 to 140 μm |
| Roller 4 | 1.8 | 50 to 90 μm | 90 to 140 μm |
| Roller 5 | 7.3 | 50 to 90 μm | 90 to 140 μm |

TABLE 3

| | | Toner | | | | Refresh Roller | | Evaluation | | | |
|---|---|---|---|---|---|---|---|---|---|---|---|
| | | No. | G' in Temp. Rising (Pa) | G' in Temp. Falling (Pa) | Amount of Heat Absorption (J/g) | No. | Average Grains Size of Abrasive Grain (μm) | Lower-limit Fixable Temp. | Blocking | Image Streaks | Image Gloss |
| Examples | 1 | 1 | 5.6 × 10^6 | 6.8 × 10^7 | 4.1 | 1 | 4.5 | B | B | B | B |
| | 2 | 2 | 7.8 × 10^5 | 1.2 × 10^7 | 8.2 | 1 | 4.5 | A | C | A | A |
| | 3 | 3 | 9.3 × 10^6 | 9.7 × 10^7 | 2.5 | 1 | 4.5 | C | A | C | B |
| | 4 | 1 | 5.6 × 10^6 | 6.8 × 10^7 | 4.1 | 2 | 2.6 | B | B | C | B |
| | 5 | 2 | 7.8 × 10^5 | 1.2 × 10^7 | 8.2 | 2 | 2.6 | A | C | A | A |
| | 6 | 3 | 9.3 × 10^6 | 9.7 × 10^7 | 2.5 | 2 | 2.6 | C | A | B | B |
| | 7 | 1 | 5.6 × 10^6 | 6.8 × 10^7 | 4.1 | 3 | 5.9 | B | B | A | C |
| | 8 | 2 | 7.8 × 10^5 | 1.2 × 10^7 | 8.2 | 3 | 5.9 | A | C | A | B |
| | 9 | 3 | 9.3 × 10^6 | 9.7 × 10^7 | 2.5 | 3 | 5.9 | C | A | B | C |
| | 10 | 4 | 2.3 × 10^6 | 2.2 × 10^7 | 4.2 | 1 | 4.5 | A | C | B | B |
| | 11 | 5 | 9.4 × 10^6 | 8.1 × 10^7 | 4.1 | 1 | 4.5 | C | A | C | B |
| | 12 | 6 | 5.5 × 10^5 | 1.3 × 10^7 | 4.2 | 1 | 4.5 | A | C | B | B |
| | 13 | 7 | 8.9 × 10^6 | 1.4 × 10^8 | 4.2 | 1 | 4.5 | C | A | C | B |
| Comparative Examples | 1 | 8 | 6.4 × 10^7 | 4.4 × 10^8 | 1.5 | 1 | 4.5 | D | A | D | C |
| | 2 | 9 | 3.1 × 10^5 | 3.2 × 10^6 | 8.9 | 1 | 4.5 | A | D | B | A |
| | 3 | 1 | 5.6 × 10^6 | 6.8 × 10^7 | 4.1 | 4 | 1.8 | B | B | D | B |
| | 4 | 1 | 5.6 × 10^6 | 6.8 × 10^7 | 4.1 | 5 | 7.3 | B | B | A | D |
| | 5 | 10 | 1.1 × 10^5 | 5.2 × 10^6 | 3.9 | 1 | 4.5 | A | D | B | A |
| | 6 | 11 | 8.2 × 10^7 | 3.4 × 10^8 | 4.2 | 1 | 4.5 | D | A | D | C |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

a developing device containing a toner, configured to form a visible image with the toner; and a fixing device configured to fix the visible image on a recording medium, the fixing device including:

a fixing rotator having a fixing surface;

an opposing rotator disposed opposing the fixing rotator to form a nip portion therebetween; and a fixing surface reformer having an abutting layer to abut the fixing surface, the abutting layer containing abrasive grains having an average grain size of from 2.0 to 6.5 μm on a surface thereof which abuts the fixing surface, wherein the toner comprises a crystalline polyester resin, wherein the toner exhibits a storage elastic modulus G' of $1.0\times10^7$ Pa or lower at 70° C. in a temperature rising in a viscoelasticity measurement, wherein the toner exhibits a storage elastic modulus G' of $1.0\times10^7$ Pa or higher at 70° C. in a temperature falling in the viscoelasticity measurement, wherein the toner exhibits an endothermic peak indicating an amount of heat absorption of from 2.0 to 8.0 J/g, derived from the crystalline polyester resin, in a first temperature rising in a differential scanning calorimetry (DSC).

2. The image forming apparatus of claim 1, wherein the amount of heat absorption is from 3.0 to 5.0 J/g.

3. The image forming apparatus of claim 1, wherein the toner exhibits a glass transition temperature (Tg1st) of from 45° C. to 65° C. in the first temperature rising in the differential scanning calorimetry, wherein the toner further comprises:

a polyester resin component A insoluble in tetrahydrofuran, exhibiting a glass transition temperature (Tg1st) of from −45° C. to 10° C. in the first temperature rising in the differential scanning calorimetry; and a polyester resin component C soluble in tetrahydrofuran, exhibiting a glass transition temperature (Tg2nd) of from 30° C. to 55° C. in a second temperature rising in the differential scanning calorimetry.

4. The image forming apparatus of claim 3, wherein the polyester resin component A comprises a trivalent or tetravalent aliphatic polyol containing 3 to 10 carbon atoms.

5. The image forming apparatus of claim 3, wherein the polyester resin component A comprises a diol having a main chain containing carbon atoms in an odd number of from 3 to 9 and a side chain containing an alkyl group.

6. The image forming apparatus of claim 3, wherein the polyester resin component A has at least one of urethane bond and urea bond.

7. The image forming apparatus of claim 3, wherein the polyester resin component C comprises a trivalent or tetravalent aliphatic polyol containing 3 to 10 carbon atoms.

8. The image forming apparatus of claim 1, further comprising:

an electrostatic latent image bearer;

an electrostatic latent image forming device configured to form an electrostatic latent image on the electrostatic latent image bearer; and a transfer device configured to transfer the visible image onto the recording medium, wherein the developing device is configured to develop the electrostatic latent image with the toner to form the visible image.

9. An image forming method comprising:

forming a visible image with a toner; and fixing the visible image on a recording medium with a fixing device including:

a fixing rotator having a fixing surface;

an opposing rotator disposed opposing the fixing rotator to form a nip portion therebetween; and a fixing surface reformer having an abutting layer to abut the fixing surface, the abutting layer containing abrasive grains having an average grain size of from 2.0 to 6.5 μm on a surface thereof which abuts the fixing surface, wherein the toner comprises a crystalline polyester resin, wherein the toner exhibits a storage elastic modulus G' of $1.0\times10^7$ Pa or less at 70° C. in a temperature rising in a viscoelasticity measurement, wherein the toner exhibits a storage elastic modulus G' of $1.0\times10^7$ Pa or higher at 70° C. in a temperature falling in the viscoelasticity measurement, wherein the toner exhibits an endothermic peak indicating an amount of heat absorption of from 2.0 to 8.0 J/g, derived from the crystalline polyester resin, in a first temperature rising in a differential scanning calorimetry (DSC).

10. The image forming method of claim 9, further comprising:

transferring the visible image onto the recording medium.

* * * * *